US009138907B2

(12) United States Patent
Binothman

(10) Patent No.: US 9,138,907 B2
(45) Date of Patent: Sep. 22, 2015

(54) FEATHER CUTTER AND FEATHER IMPING PIN

(71) Applicant: Albara Mohammed Binothman, Portland, OR (US)

(72) Inventor: Albara Mohammed Binothman, Portland, OR (US)

( * ) Notice: Subject to any disclaimer, the term of this patent is extended or adjusted under 35 U.S.C. 154(b) by 354 days.

(21) Appl. No.: 13/764,151

(22) Filed: Feb. 11, 2013

(65) Prior Publication Data

US 2014/0224088 A1 Aug. 14, 2014

(51) Int. Cl.

| | |
|---|---|
| ***B26D 7/01*** | (2006.01) |
| ***B26D 1/26*** | (2006.01) |
| ***B26D 1/08*** | (2006.01) |
| ***A61D 1/00*** | (2006.01) |

(52) U.S. Cl.

CPC .. *B26D 7/01* (2013.01); *A61D 1/00* (2013.01); *B26D 1/08* (2013.01); *B26D 1/26* (2013.01); *B26D 2007/013* (2013.01); *Y10T 83/384* (2015.04); *Y10T 83/391* (2015.04); *Y10T 83/7593* (2015.04)

(58) Field of Classification Search

CPC ..... B26D 7/01; B26D 1/26; B26D 2007/013; B26D 1/08; A61D 1/00; Y10T 83/793; Y10T 83/384

USPC ..... 83/184, 467.1, 178, 654, 655, 664, 699, 83/163, 408, 433, 407, 419, 425.1, 732, 83/88, 84, 477.1, 477, 639.1, 623, 54, 185, 83/192, 193, 194; 241/97, 222, 247, 241/282.2; 30/93, 95, 103, 104

See application file for complete search history.

(56) References Cited

U.S. PATENT DOCUMENTS

| | | | | |
|---|---|---|---|---|
| 875,334 A | | 12/1907 | Eckley | |
| 1,017,213 A | * | 2/1912 | Hottmann | 241/97 |
| 2,419,184 A | | 4/1947 | Young | |
| 2,493,513 A | | 1/1950 | Wagner | |
| 2,926,016 A | | 2/1960 | Neal et al. | |
| 3,286,572 A | * | 11/1966 | Berg | 83/468.8 |
| 3,582,438 A | | 6/1971 | Harbour | |
| 3,913,434 A | * | 10/1975 | Smithers | 83/163 |

(Continued)

FOREIGN PATENT DOCUMENTS

JP 02071916 A * 3/1990 ..... B23D 21/14

OTHER PUBLICATIONS

"Little Chopper Feather Cutter"; http://www.shop.bigjimsbowcompany.com/Little-Chopper-Feather-Cutter-F4300.htm; 2 pages.

(Continued)

*Primary Examiner* — Ghassem Alie

(74) *Attorney, Agent, or Firm* — Oblon, McClelland, Maier & Neustadt, L.L.P.

(57) ABSTRACT

Feather cutters are described that cut a feather shaft of a feather. One feather cutter includes a first sildable arm and a second sildable arm that move in a linear direction with respect to each other between a first position and a second position, a plurality of springs that are placed between the first sildable arm and the second sildable arm, an adjustable blade that is attached to the first sildable arm via a screw and cuts the feather shaft of the feather upon moving the first sildable arm to the second position, a shaft cylinder with two slits that is attached to the second sildable arm and the feather shaft of the feather is placed within the shaft cylinder to hold the feather shaft which is being cut with the adjustable blade in a fixed position.

6 Claims, 27 Drawing Sheets

(56) References Cited

U.S. PATENT DOCUMENTS

| | | | | |
|---|---|---|---|---|
| 3,922,401 | A | 11/1975 | Bear | |
| 4,510,109 | A * | 4/1985 | Carella | 264/151 |
| 4,515,048 | A * | 5/1985 | Forsell | 83/13 |
| 4,884,755 | A | 12/1989 | Hedrington | |
| 5,465,981 | A | 11/1995 | Klaus | |
| 6,718,637 | B1 | 4/2004 | Ortner et al. | |
| 7,604,033 | B2 | 10/2009 | Gray | |
| 8,201,484 | B2 | 6/2012 | Workman et al. | |
| 2005/0210681 | A1 | 9/2005 | Pydde et al. | |
| 2010/0170373 | A1 * | 7/2010 | Green | 83/13 |
| 2011/0078905 | A1 | 4/2011 | Macsay et al. | |
| 2011/0214299 | A1 | 9/2011 | Heh | |
| 2012/0011976 | A1 * | 1/2012 | Kawakami | 83/54 |

OTHER PUBLICATIONS

"SJM Young Feather Trimmer"; http://ozbo.com/SJM-Young-Feather-Trimmer-K1-1743.html; 3 pages.

U.S. Appl. No. 13/757,348, filed Feb. 1, 2013, Binothman.

* cited by examiner

FEATHER CUTTER AND FEATHER IMPING PIN

GRANT OF NON-EXCLUSIVE RIGHT

This application was prepared with financial support from the Saudi Arabian Cultural Mission (SACM), and in consideration therefore the present inventor has granted The Kingdom of Saudi Arabia a non-exclusive right to practice the present invention.

CROSS REFERENCE TO RELATED APPLICATIONS

The present application contains subject matter related to that described in commonly owned Saudi application No. 110310420, filed May 19, 2012, at the Saudi Arabian General Directorate of Industrial Property Filing and Granting, the contents of which being incorporated herein in its entirety in the present application.

BACKGROUND

Field of the Disclosure

This disclosure relates to a feather cutter and feather imping pin, and more specifically, to a feather cutter that do not disturb barbs of a feather being cut and a feather imping pin with a roughened surface.

SUMMARY

A feather cutter that cuts a feather shaft of a feather, the feather cutter including a first sildable arm and a second sildable arm that move in a linear direction with respect to each other between a first position and a second position, the first sildable arm and the second sildable arm having first slides and second slides, respectively, that guide a movement of the first sildable arm and the second sildable arm in the linear direction between the first position and the second position, a plurality of springs that are placed between the first sildable arm and the second sildable arm, an adjustable blade that is attached to the first sildable arm and cuts the feather shaft of the feather upon moving the first sildable arm to the second position, and a shaft cylinder with two slits that is attached to the second sildable arm and the feather shaft of the feather is placed within the shaft cylinder to hold the feather shaft which is being cut with the adjustable blade in a fixed position.

BRIEF DESCRIPTION OF THE DRAWINGS

A more complete appreciation of the present application and many of the advantages thereof will be readily obtained as the same becomes better understood by reference to the following detailed description when considered in connection with the accompanying drawings, wherein.

DETAILED DESCRIPTION

Figure 1:
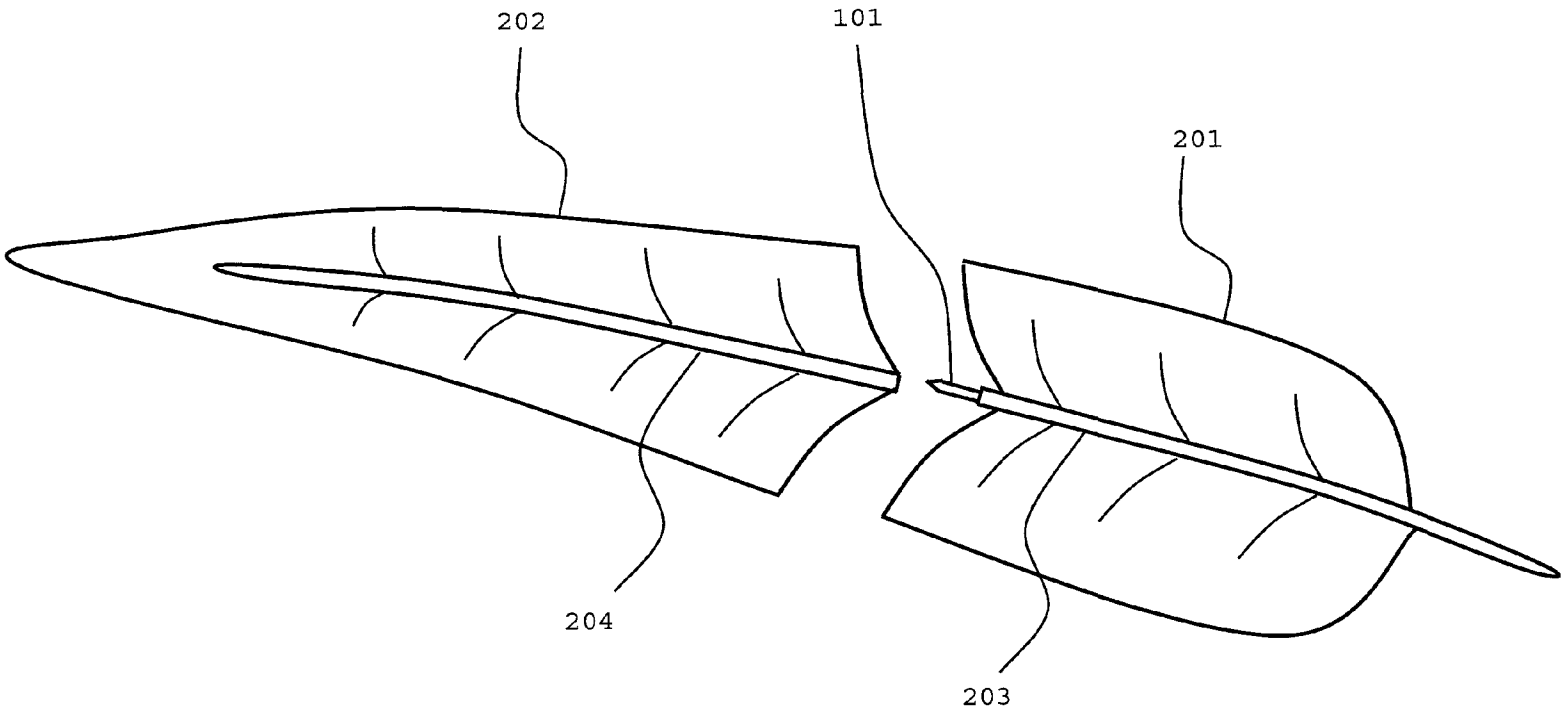
FIG. 1 is an exemplary embodiment of a donor feather, a receiving feather, and a feather imping pin that attaches the donor feather to the receiving feather such that the feather imping pin is inserted into a shaft of the receiving feather.

Referring now to the drawings, FIG. 1 illustrates an exemplary embodiment of a donor feather 202, a receiving feather 201, and a feather imping pin 101 that attaches the donor feather 202 to the receiving feather 201 such that the feather imping pin 101 is inserted into a broken shaft 203 of the receiving feather 201. In most cases, the receiving feather 201 is still attached to an avian but a natural end portion of the avian's feather is missing, damaged or otherwise ineffective.

Figure 2:
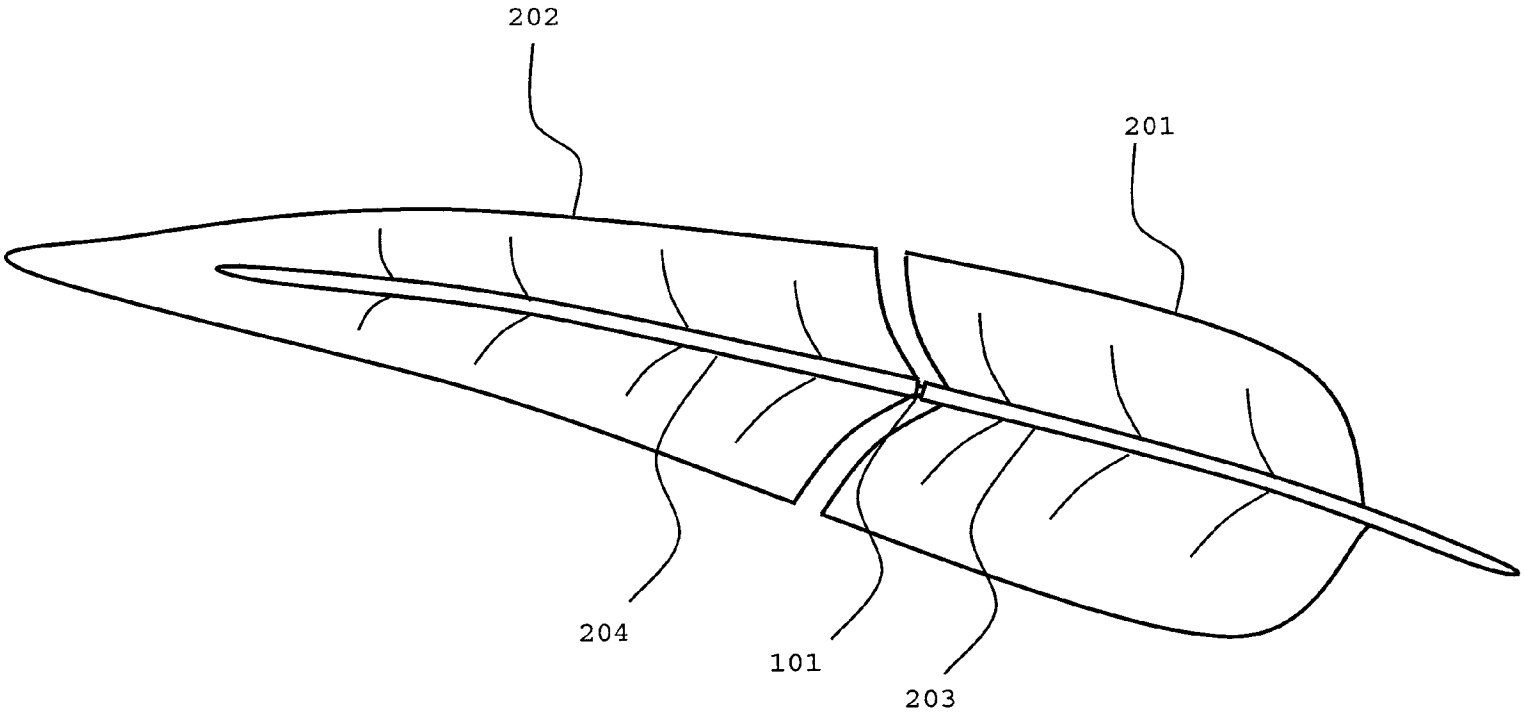
FIG. 2 is an exemplary embodiment of a donor feather, a receiving feather, and a feather imping pin that attaches the donor feather to the receiving feather such that the donor feather and the receiving feather are connected to each other using the feather imping pin.

FIG. 2 illustrates an exemplary embodiment of the donor feather 202, the receiving feather 201, and the feather imping pin 101 after the donor feather 202 and the receiving feather 201 are connected to each other by the feather imping pin 101.

Feather imping is performed using the feather imping pin 101 that connects the donor feather 202 and the receiving feather 201. The feather imping pin 101 fits inside both the broken shaft 203 of the receiving feather 201 and the newly cut shaft 204 of the donor feather 202. The feather imping pin 101 fits tightly inside both the broken shaft 203 and the newly cut shaft 204. The feather imping pin 101 may be inserted inside the broken shaft 203 and newly cut shaft 204 symmetrically or asymmetrically. For example, a ratio of a length of the feather imping pin 101 that is inserted into the broken shaft 203 to a length of the feather imping pin 101 that is inserted into the newly cut shaft 204 may be 1:1, 0.8:1, 1:0.8, 1:0.5, or 0.5:1. The feather imping pin 101 may include one or more marks to indicate a length to be inserted into the broken shaft 203 and the newly cut shaft 204. The feather imping pin 101 may be further secured/fixed with glue or other adhesive. Examples of glues and adhesives that can be used to further secure the feather imping pin 101 include, but are not limited to, cyanoacrylate, super glue, and epoxy.

The receiving feather 201 is usually attached to an avian but may also be a feather that is detached from an avian. The feather imping process may be performed to fix the feather of the avian as a medical aid. The avian may be sedated while the feather imping is being performed. Alternatively, the feather imping may be performed to only fix a detached feather. The feather imping may be used to connect one or more than one donor feather to the receiving feather or donor feather. For example, feather imping may be performed to connect a second donor feather to a first donor feather that is already connected to the receiving feather.

Figure 3:
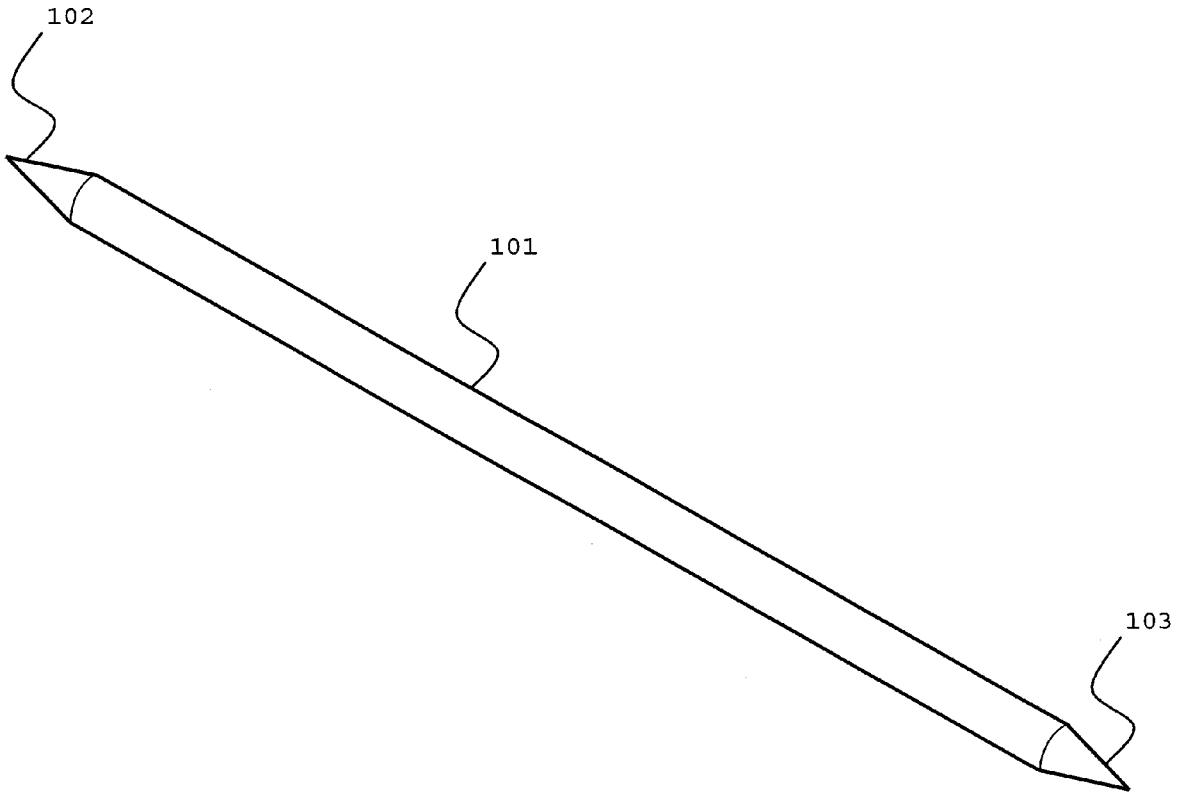
FIG. 3 is an exemplary embodiment of a feather imping pin having two ends such that the two ends have a same size.

FIG. 3 illustrates an exemplary embodiment of the feather imping pin 101 having a shaft that is cylindrical with two tapered ends 102 and 103 such that the two ends 102 and 103 have the same shape and size. The feather imping pin 101 may have different dimensions based on a type and a size of the receiving feather 201 and the donor feather 202. For example, the feather imping pin 101 may be 5, 10, 20, 30, 40, 50, 100, 150, 200 mm long. In other embodiments, a length of the feather imping pin 101 may be any value in the range from 2 mm to 300 mm. The feather imping pin 101 diameter may be in the range from 0.1 mm to 5 mm. Various sizes of feather imping pins may be included in a kit, where the sizes are pre-set depending on the avian species being treated. It should be noted that a size and a diameter of the feather imping pin 101 may be different in other embodiments and the functionality of the feather imping pin 101 is independent of a size and a dimension of the feather imping pin 101. The taper of the two ends 102 and 103 of the feather imping pin 101 may be cone-shaped with a sharp tip, cone-shaped with a rounded tip, or oval-shaped (half-egg-shaped). The two ends 102 and 103 of the feather imping pin 101 may have the same shape or may have different shapes. The feather imping pin 101 may have different colors to match a color of the feather or a color of the feather shaft. Optionally, the feather imping pin 101 may include a GPS receiver and a wireless transmitter with a battery power source so the avian that receives the feather imping pin 101 may be tracked and/or located remotely.

The feather imping pin 101 may be made of materials having a similar density as of the feather. Additionally, the feather imping pin 101 may be made of materials having a similar flexibility as of the feather. Alternatively, feather imping may be performed using the feather imping pin 100 that is flexible or non-flexible. Examples of materials that the feather imping pin 101 can be made of include, but are not limited to, titanium, aluminum, fiber glass, carbon fiber composite, and/or plastic.

Figure 4:
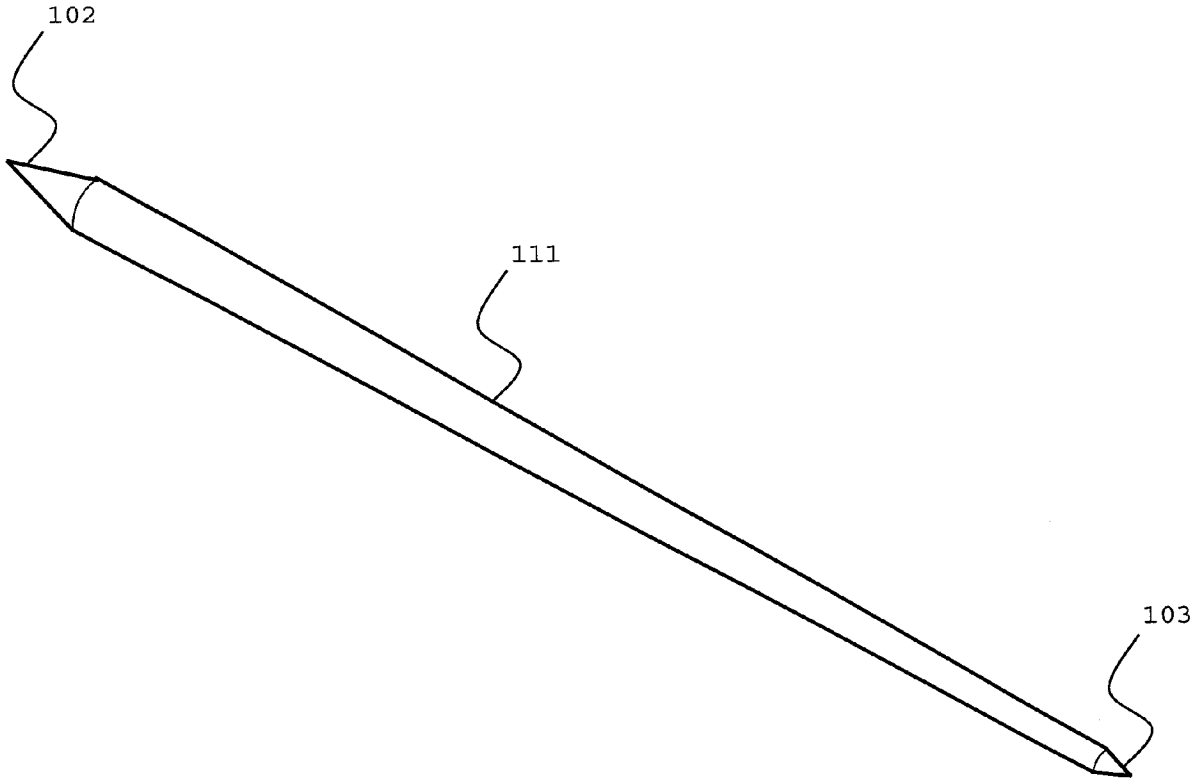
FIG. 4 is an exemplary embodiment of a feather imping pin having two ends such that the two ends have different sizes.

FIG. 4 illustrates an exemplary embodiment of a feather imping pin 111 having two ends 102 and 130 such that the two ends 102 and 130 have different sizes, and that the diameter of the feather imping pin 111 at the one end 130 is smaller than the diameter of the feather imping pin 101 at the other end 102. The diameter of the feather imping pin 111 at each of the two ends 102 and 130 is selected based on an inner or outer diameter of the broken shaft 203 of the receiving feather 201 and an inner or outer diameter of the newly cut shaft 204 of the donor feather 202. For example, a diameter of the broken shaft 203 of the receiving feather 201 may be larger than a diameter of the newly cut shaft 204 of the donor feather 202. In this case the feather imping pin 111 is inserted into the broken shaft 203 from the end having the larger diameter, that is 102.

Figure 5B:
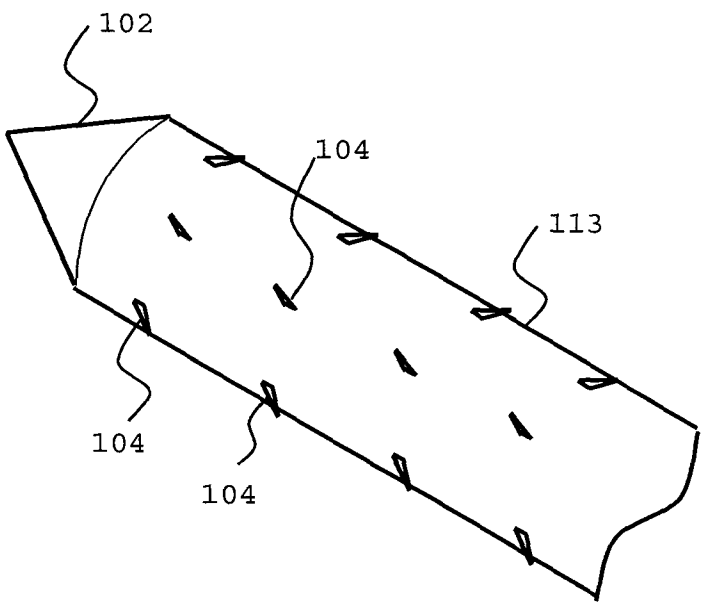
FIG. 5*b* is an exemplary close-up view of an exemplary embodiment of a feather imping pin with tilted teeth, where the tilted teeth are tilted in opposite directions.
Figure 5A:
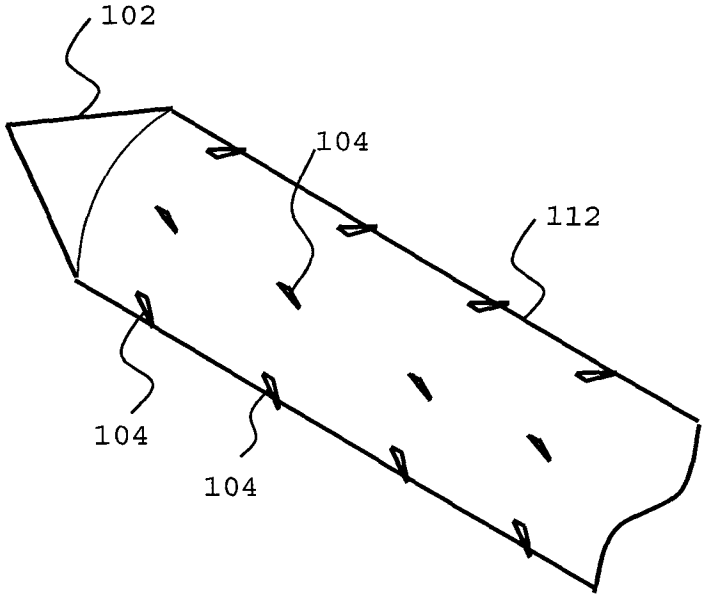
FIG. 5*a* is an exemplary close-up view of an exemplary embodiment of a feather imping pin with tilted teeth, where the tilted teeth are tilted in a same direction.

FIG. 5*a* and FIG. 5*b* are close-up views of exemplary embodiments of feather imping pins 112 and 113 with tilted teeth 104, where the tilted teeth 104 are tilted in a same direction or in opposite directions, respectively. The tilted teeth 104 may be a first group of teeth close to the one end of the shaft tilted at a first angle, for example, 15°, 20°, 30°, or 45°, against the surface of the shaft, and a second group of teeth close to the other end of the shaft tilted at a second angle, for example, 15°, 20°, 30°, or 45°, against the surface of the shaft. Preferably, the first angle and second angle is between 5° and 50°.

It should be noted that when the feather imping pins 112 and 113 does not have tilted teeth 104, upon pressure to the feather after performing the feather imping, the donor feather 202 may rotate around the feather imping pins 112 and 113 or move along the feather imping pins 112 and 113, causing the feather to break again after the feather imping, which results in a need for re-imping the broken feather. Performing the feather imping with feather imping pins 112 and 113 having the tilted teeth 104 provides an advantage that the feather imping results in a more durable feather imping and a lower likelihood of a re-break of the feather. The feather imping pins, as disclosed in this application, may be made entirely from one material or may be made of a combination of different materials. For example, the tilted teeth 104 of the feather imping pins 112 and 113 may be made of a metal that is assembled on a plastic rod. Additionally, the tilted teeth 104 may cover the surface of the feather imping pins 112 and 113 entirely or partially.

Figures 6A, 6B, 6C:
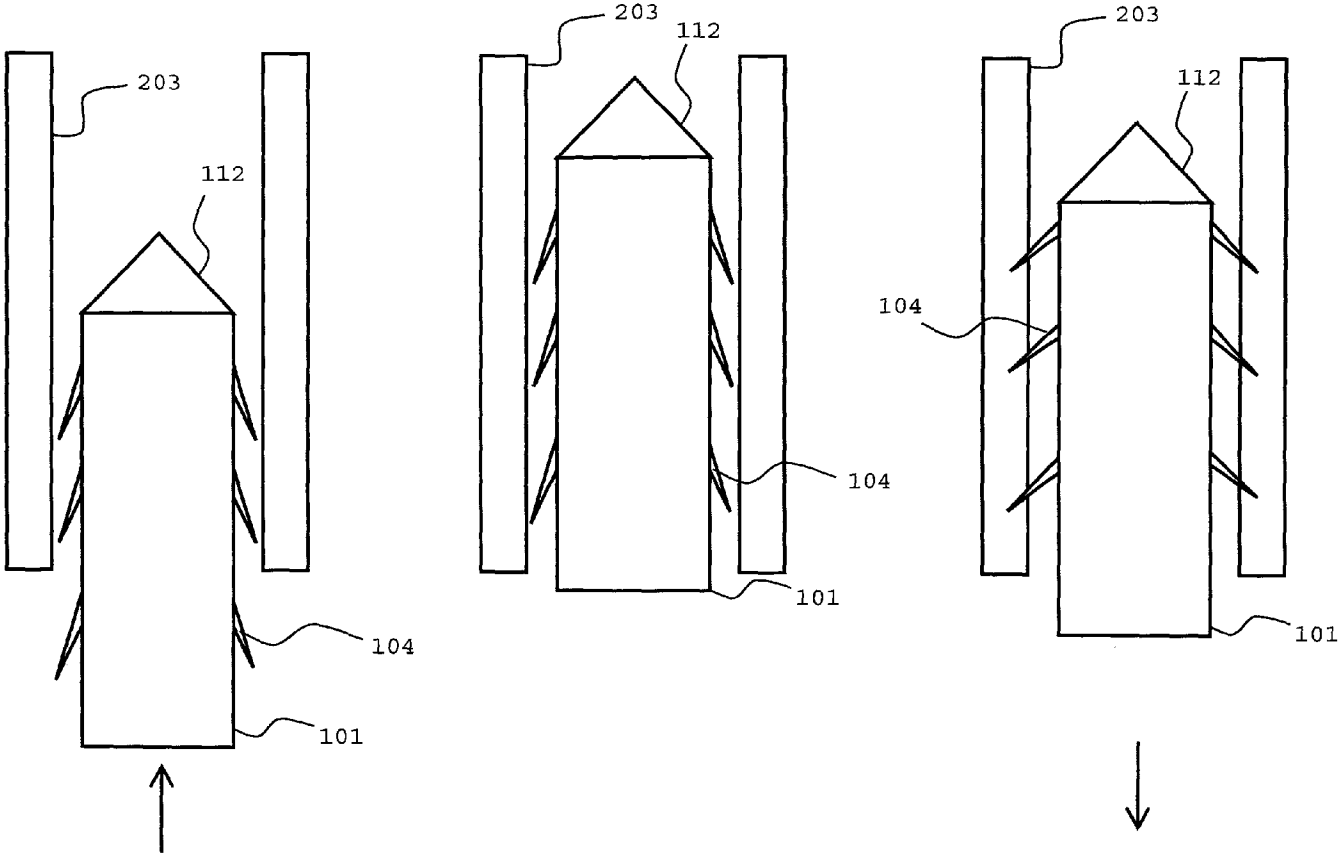
FIGS. 6*a*, 6*b*, and 6*c* are exemplary cross sectional close-up views of an exemplary embodiment of a feather imping pin with tilted teeth, where the tilted teeth are tilted in a same direction, and the feather imping pin is being inserted into a feather shaft and the tilted teeth are getting engaged with the feather shaft.
Figure 7:
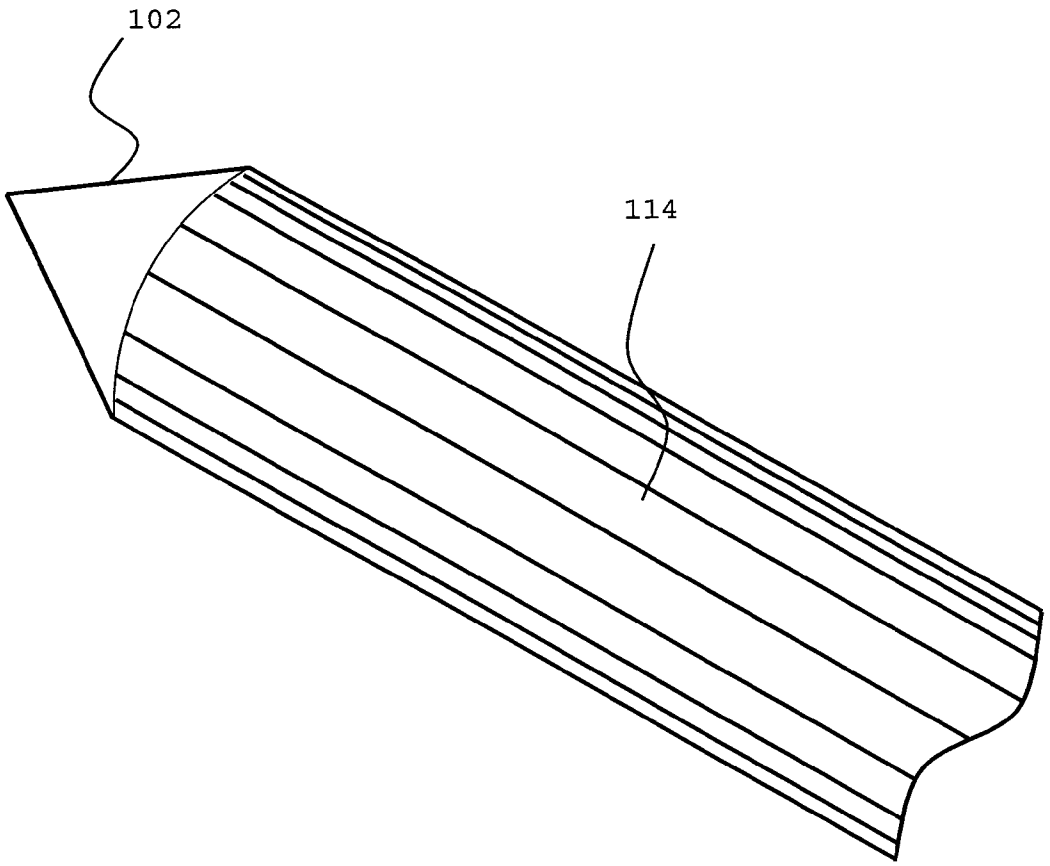
FIG. 7 is an exemplary close-up view of an exemplary embodiment of a feather imping pin with longitudinal grooves.
Figure 8:
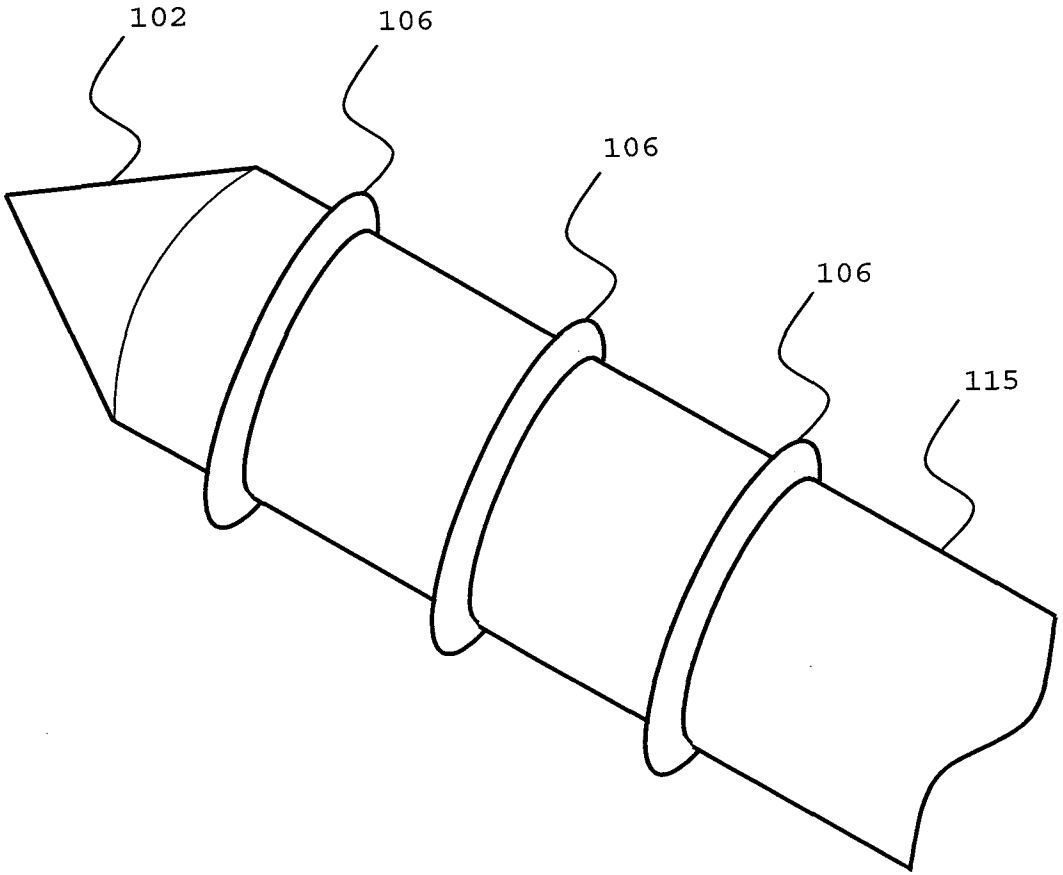
FIG. 8 is an exemplary close-up view of an exemplary embodiment of a feather imping pin with circular grooves.
Figure 9:
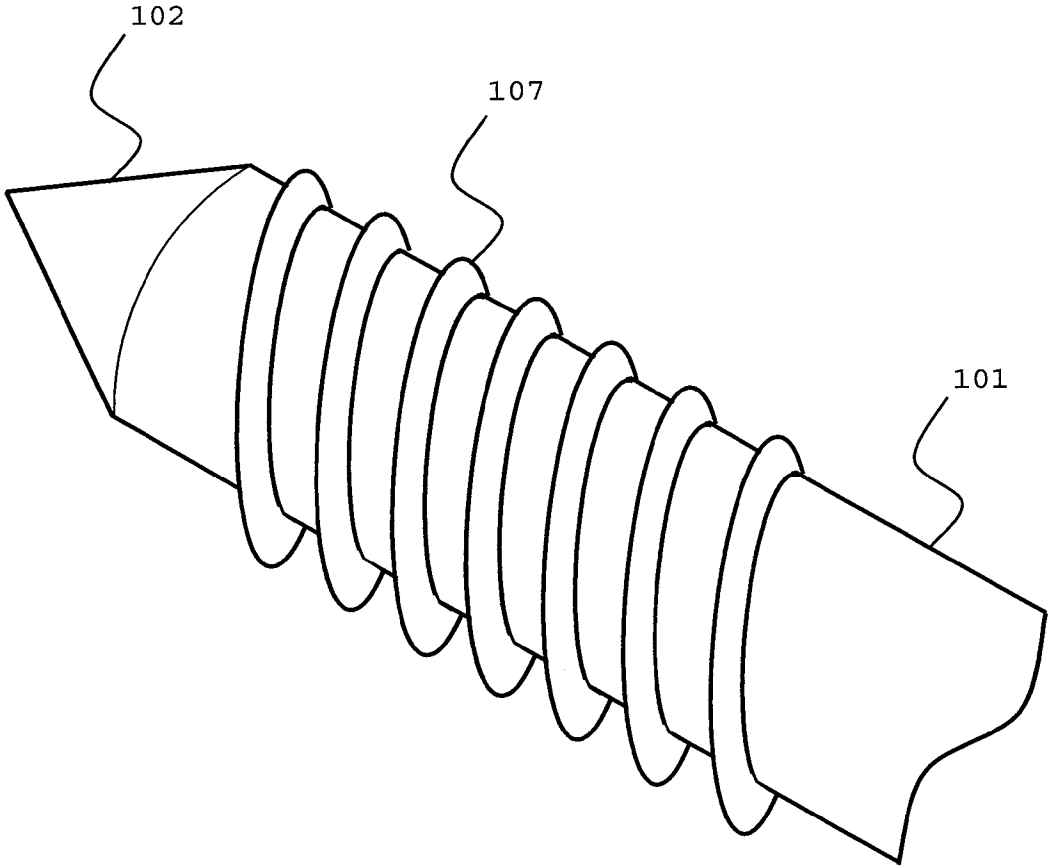
FIG. 9 is an exemplary close-up view of an exemplary embodiment of a feather imping pin with spiral grooves.
Figure 10:
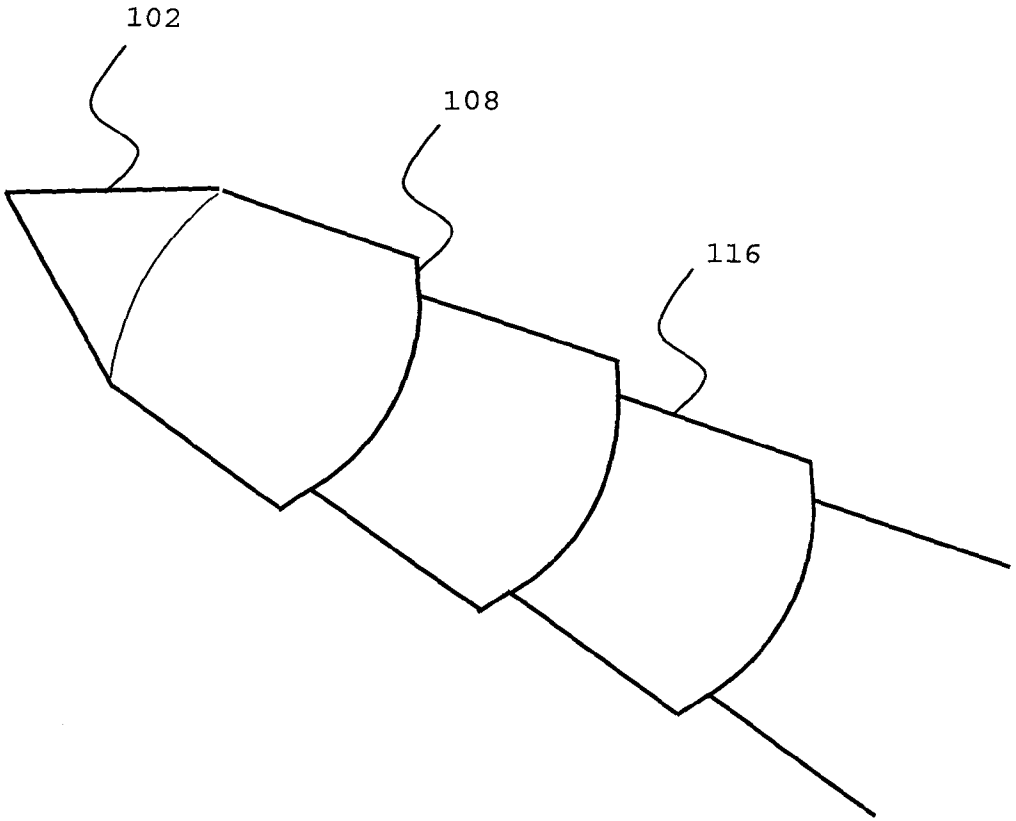
FIG. 10 is an exemplary close-up view of an exemplary embodiment of a feather imping pin with half-cone grooves.

FIGS. 6*a*, 6*b*, and 6*c* illustrate exemplary cross sectional close-up views of an exemplary embodiment of the feather imping pin 112 with tilted teeth 104, where the tilted teeth 104 are tilted in a same direction, and the feather imping pin 112 is being inserted into the broken shaft 203. As shown in FIG. 6*a*, while inserting the feather imping pin 112 into the broken shaft 203 of the receiving feather 201, the tilted teeth 104 are not engaged with the inner surface of the broken shaft 203. In this case, while inserting the feather imping pin 112 into the broken shaft 203, the tilted teeth 104 slide in the inner surface of the broken shaft 203. In order to secure/fix the feather imping pin 112 in the broken shaft 203, the feather imping pin 112 is inserted to the broken shaft 203 and then moved back/out. While retracting the feather imping pin 112, the sharp heads of the tilted teeth 104 of the feather imping pin 112 are engaged with, and penetrate into, the inner surface of the broken shaft 203, which result in securing the feather imping pin 112 inside the broken shaft 203. The same procedure can be applied when inserting the feather imping pin 112 into the newly cut shaft 204.

FIGS. 7, 8, 9, and 10 illustrate exemplary close-up views of various embodiments of the feather imping pins 114, 115, 116, 117 with roughened surfaces of longitudinal grooves 114, circular grooves 106, spiral grooves 107, and half-cone grooves 108, respectively. The roughened surfaces may cover the surface of the feather imping pins entirely or partially. For example, the roughened surface may only cover the areas close to the two ends 102 and 103 of the feather imping pins. The feather imping pins, as disclosed in the present application, may have only one of the above-noted roughened surfaces or may have any combination of the above-noted roughened surfaces. For example, the feather imping pins, as disclosed in the present application, may have half-cone grooves 108 at one half and may have spiral grooves 107 at the other half. It should be noted that the surface of the feather imping pins may be roughened with similar geometries and the above-noted examples are not aimed to limit the scope of the present application. Any similar roughened surfaces to secure the feather imping pin within the newly cut shaft 204 and/or the broken shaft 203, which prevents rotation of the receiving feather 201 and/or the donor feather 202 around the feather imping pin, and/or prevents movement of the receiving feather 201 and/or the donor feather 202 along the feather imping pin are also in the scope of this application. Additionally, the two ends 102 and 103 of the feather imping pin may be roughened.

Figure 11:
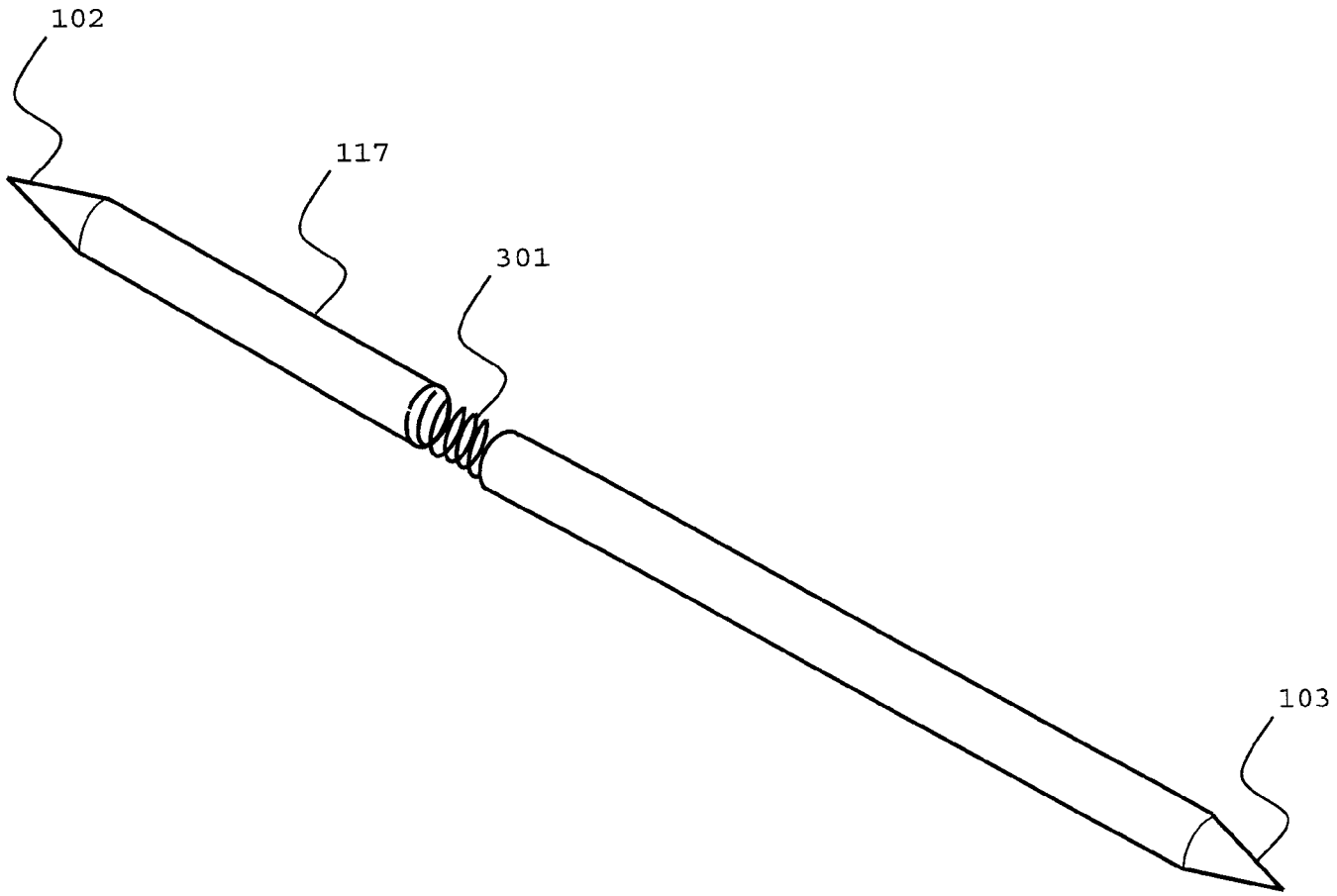
FIG. 11 is a an exemplary embodiment of a feather imping pin that is extendable via one spring-loaded section along the feather imping pin.

FIG. 11 illustrates an exemplary embodiment of a feather imping pin 118 that is extendable via one spring-loaded section 301 along the feather imping pin 118. The feather imping pin 101 may be extended via one or more spring loaded sections 301 along the feather imping pin 118. Additionally, the spring loaded section 301 may be used to add flexibility to the feather imping pin 118.

Figure 12:
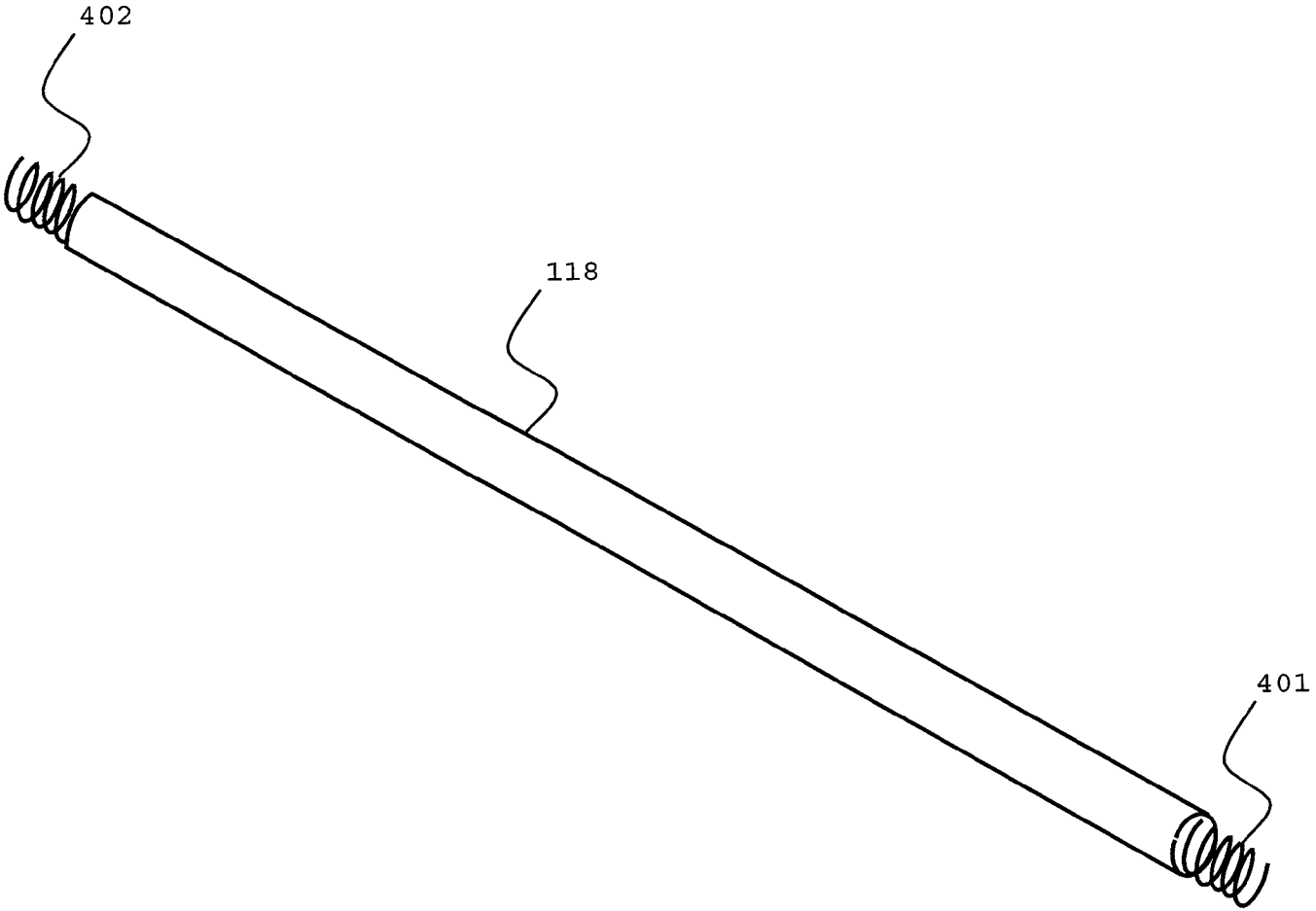
FIG. 12 is a an exemplary embodiment of a feather imping pin that is roughened at two ends using two springs.

FIG. 12 illustrates an exemplary embodiment of a feather imping pin 119 that is roughened at two ends using two springs 401 and 402. In this case, the surface of the feather imping pin 119 may be roughened similarly using the above-noted geometries for roughening the surface of the feather imping pin 119.

Figure 13:
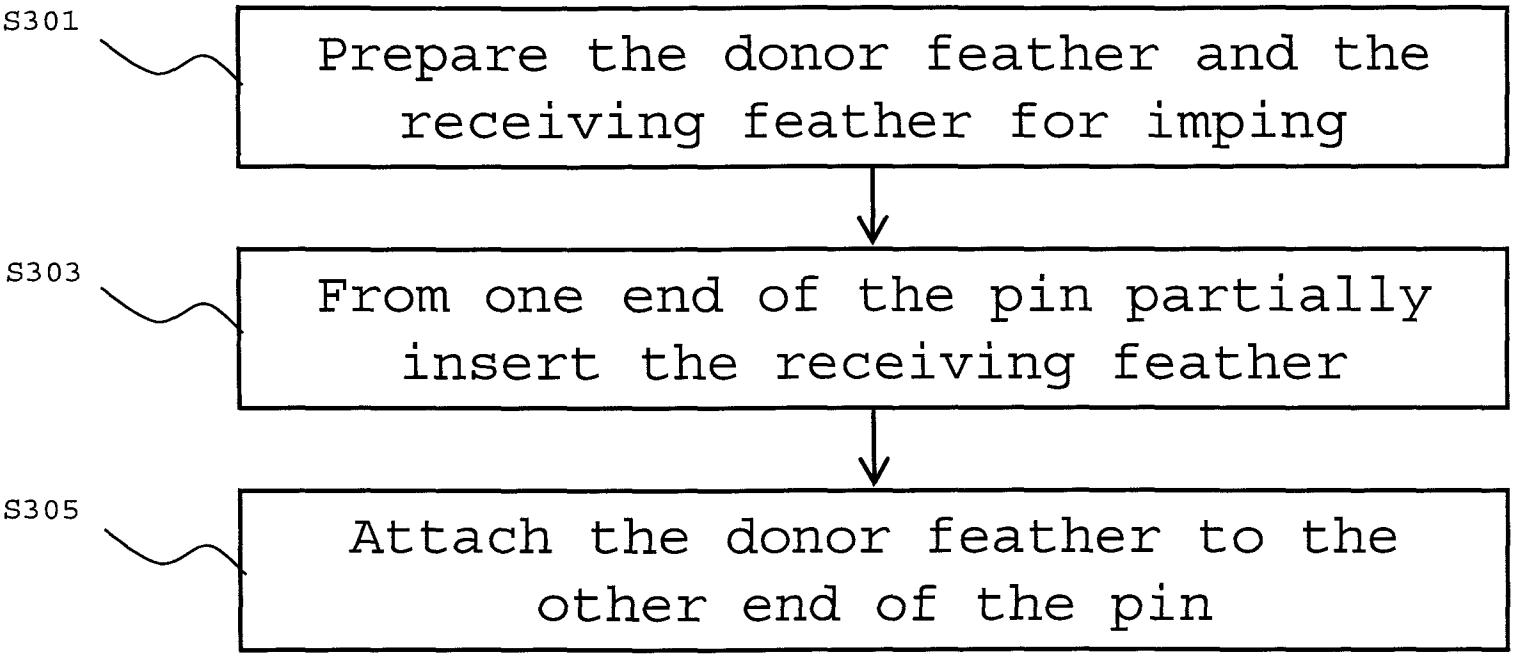
FIG. 13 is a flowchart of a method for imping a donor feather and a receiving feather using a feather imping pin.

FIG. 13 is a flowchart of a method for imping the donor feather 202 and the receiving feather 201 using a feather imping pin according to one embodiment. At step S301, the donor feather 202 and the receiving feather 201 are prepared. The preparation may include cutting the donor feather 202 and/or the receiving feather 201 to appropriate length. The donor feather 202 and/or the receiving feather 201 may be cut such that the sizes of the cross-sections of their corresponding shafts match. The circumference of the shafts may be measured and marked prior to cutting. It is preferred that the donor feather 202 and the receiving feather 201 to be from a same type and a same kind. However, different types and kinds of the donor feather 202 and the receiving feather 201 may be attached.

At step S303, the feather imping pin (any of the embodiments disclosed in the present application) is partially inserted into the broken shaft 203 of the receiving feather 201. Glue may be applied to the pin prior to insertion. The feather imping pin may be extended to a desirable length before insertion. The extension may be via releasing one or more spring-loaded extension portions along the shaft of the feather imping pin.

At step S305, the donor feather 202 is attached to the exposed end of the feather imping pin. Glue may be applied (in any embodiment) to the feather imping pin prior to attachment. Alternatively, the feather imping pin may be partially inserted into the newly cut shaft 204 of the donor feather 202, and then, the receiving feather 201 may be attached to the exposed end of the feather imping pin.

The feather imping pin is first partially inserted into the broken shaft 203 of the receiving feather 201. Then, the donor feather 202 can be attached to the exposed end of the feather imping pin, which is inserted into the newly cut shaft 204 of the donor feather 202. Alternatively, the feather imping pin may be first partially inserted into the newly cut shaft 204 of the donor feather 202, and then, the receiving feather 201 can be attached to the exposed end of the feather imping pin, which is inserted into the broken shaft 203 of the receiving feather 201. Glue may be applied to the feather imping pin prior to any of the above-noted insertions or attachments.

It is preferred that the donor feather is selected/cut such that, after attachment, the donor feather 202 and the receiving feather 201, collectively, look like an undamaged/full receiving feather 201. It is preferred that, if the feather imping is performed on an avian that is alive and has many broken feathers that needs to be fixed, the avian being sedated.

According to another embodiment of the present application, a kit may be provided for quick feather imping. The kit may include any embodiment of the disclosed feather imping pins as described in this application. Additionally, the kit may include a plurality of feather imping pins having different sizes and lengths. The kit may further include a feather imping cutter. The kit may further include a measurement device to measure the sizes, for example, a cross-section size of the receiving feather 201 and/or the donor feather 202. The kit may further include a marker to mark the receiving feather 201 and/or the donor feather 202 before cutting. The kit may include glue for more secure and coherent feather imping. The kit may be used to fix avian having broken feathers by imping broken feathers. In the following exemplary embodiments of feather cutters are disclosed.

Figure 14:
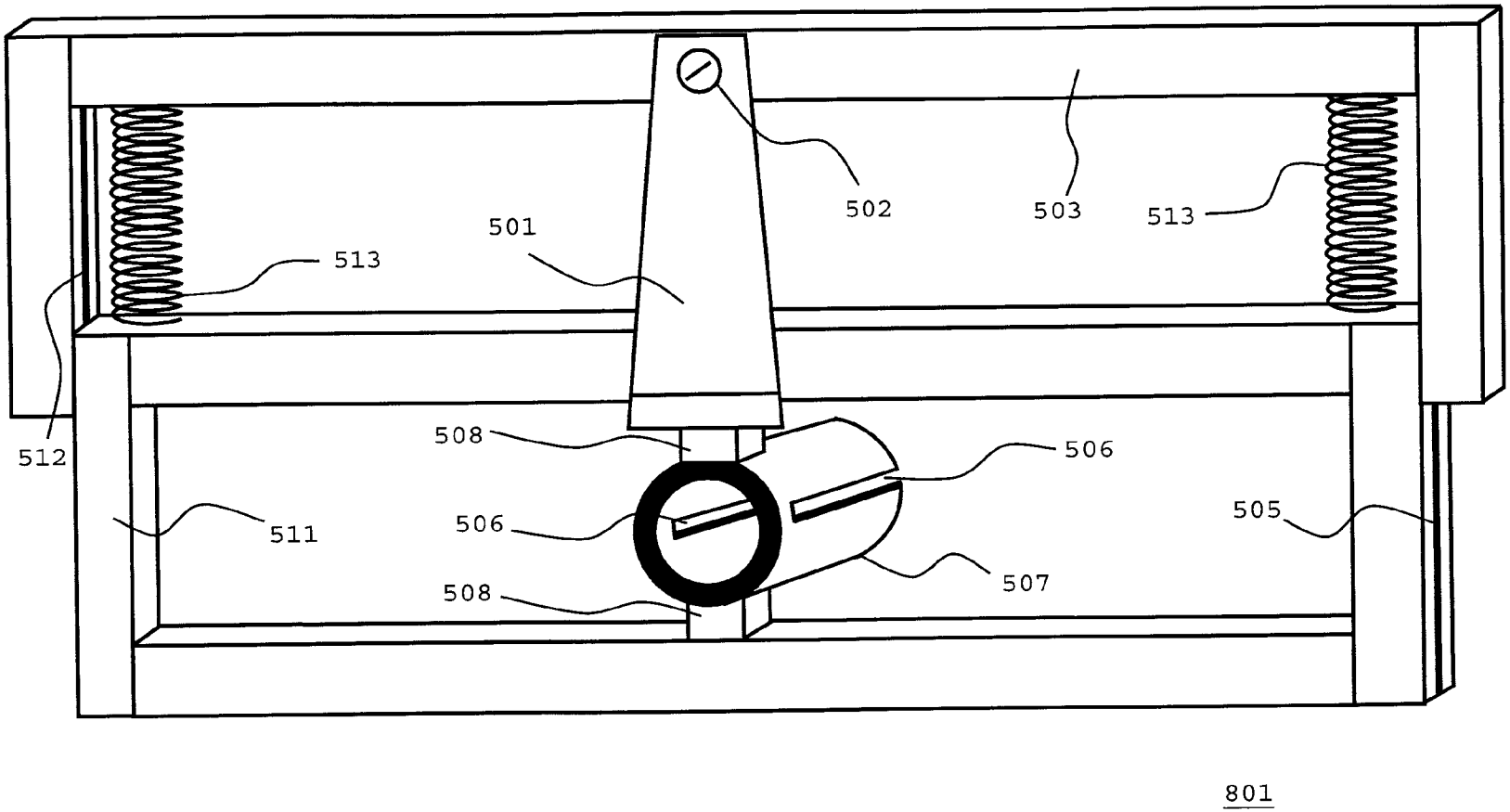
FIG. 14 is a perspective view of an exemplary embodiment of a feather cutter with a first and a second sildable arms having an adjustable blade and a shaft cylinder with two slits in a raised position.

FIG. 14 illustrates a perspective view of an exemplary embodiment of a feather cutter 801 with a first sildable arm 503 and a second sildable arm 511 having an adjustable blade 501 and a shaft cylinder 507 with two slits 506 such that the first sildable arm 503 is in a raised position. The feather cutter 801 can cut a feather shaft of a feather without damaging the feather structure. A first slide 512 of the first sildable arm 503 and a second slide 505 of the second sildable arm 511 are engaged with each other and guide movement of the first sildable arm 503 and the second sildable arm 511 in a linear direction with respect to each other. It should be noted that each of the first and the second sildable arms 503 and 511 has two slides on two sides and only one of the two slides on each arm is shown in the perspective view of the feather cutter 801 as illustrated in FIG. 14. The movement of the first sildable arm 503 and the second sildable arm 511 are limited at two ends of the first slide 512 and the second slide 505.

A plurality of springs 513 are placed between the first sildable arm 503 and the second sildable arm 511, which force the feather cutter 801 to the raised position. The adjustable blade 501 is fixed on the first sildable arm 503 using one or more screws 502. A position of the adjustable blade 501 can be adjusted by driving the screw 502 open, adjusting the adjustable blade 501, and fastening the screw 502 after the adjustable blade 501 is adjusted.

A plurality of shaft cylinder arms 508 fix/attach the shaft cylinder 507, which is non-movable, to the second adjustable arm 511. The shaft cylinder 507 have two slits 506 such that when a feather is inserted into the shaft cylinder 507, barbs of the feather are not disturbed. The shaft cylinder 507 is used to hold, in a fixed position, a shaft of a feather that is being cut by the feather cutter 801.

Figure 15:
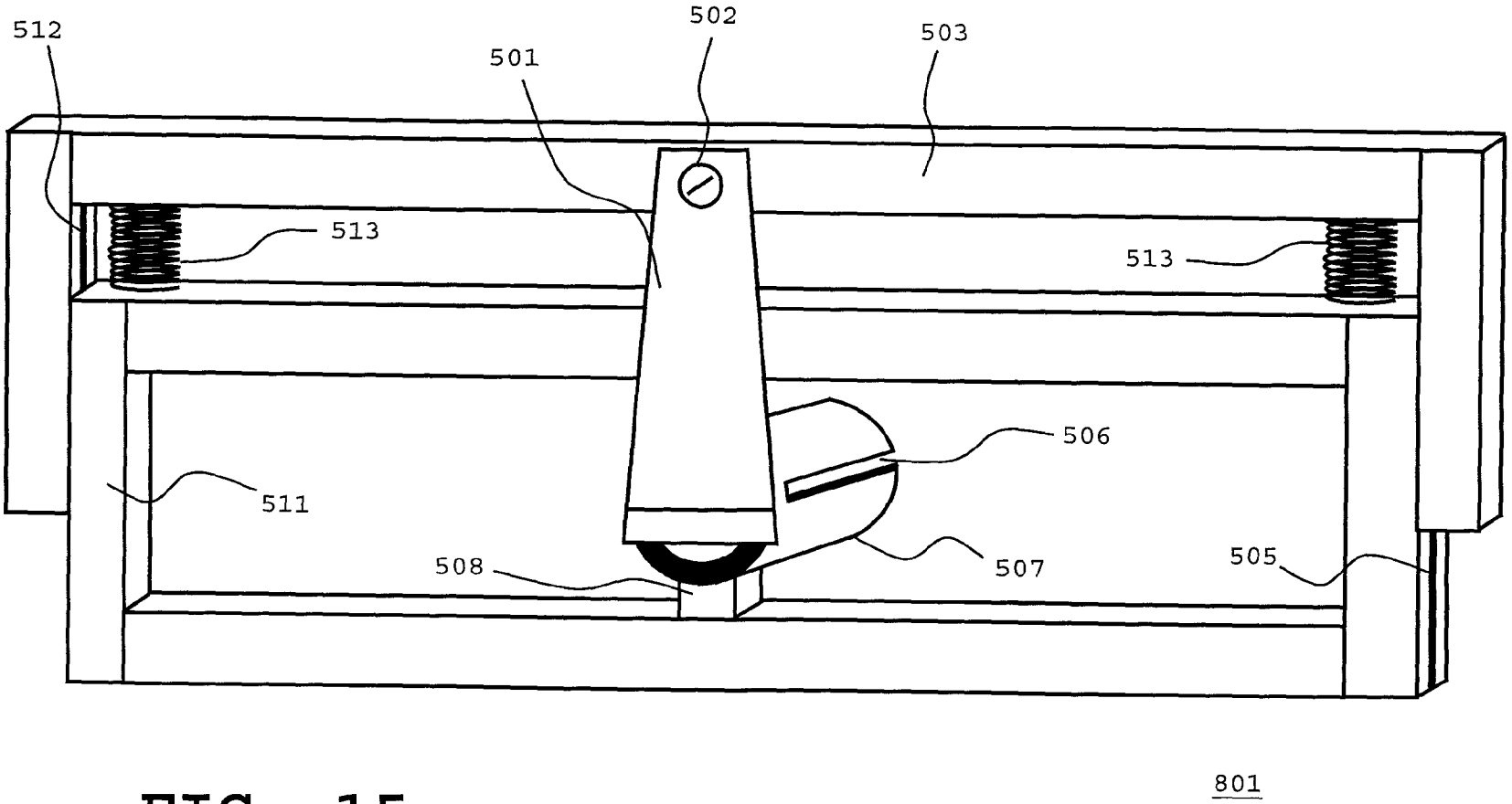
FIG. 15 is a perspective view of an exemplary embodiment of a feather cutter with a first and a second sildable arms having an adjustable blade and a shaft cylinder with two slits in a lowered position.

FIG. 15 illustrates a perspective view of an exemplary embodiment of the feather cutter 801 with the first sildable arm 503 and the second sildable arm 511 having the adjustable blade 501 and the shaft cylinder 507 with two slits 506 such that the first sildable arm 503 is in a lowered position. Providing forces to an upper side of the first sildable arm 503 and a lower side of the second sildable arm 511 results in the plurality of springs 513 being compressed. In this case, the adjustable blade 501 that is attached to the first sildable arm 503 tangentially passes through an opening of the shaft cylinder 507 and cuts any portion of a feather shaft that remains outside of the opening of the shaft cylinder 507. The plurality of springs 513 provide a force to place the feather cutter 801 in the raised position when the feather cutter 801 is in the lowered position.

Figure 16:
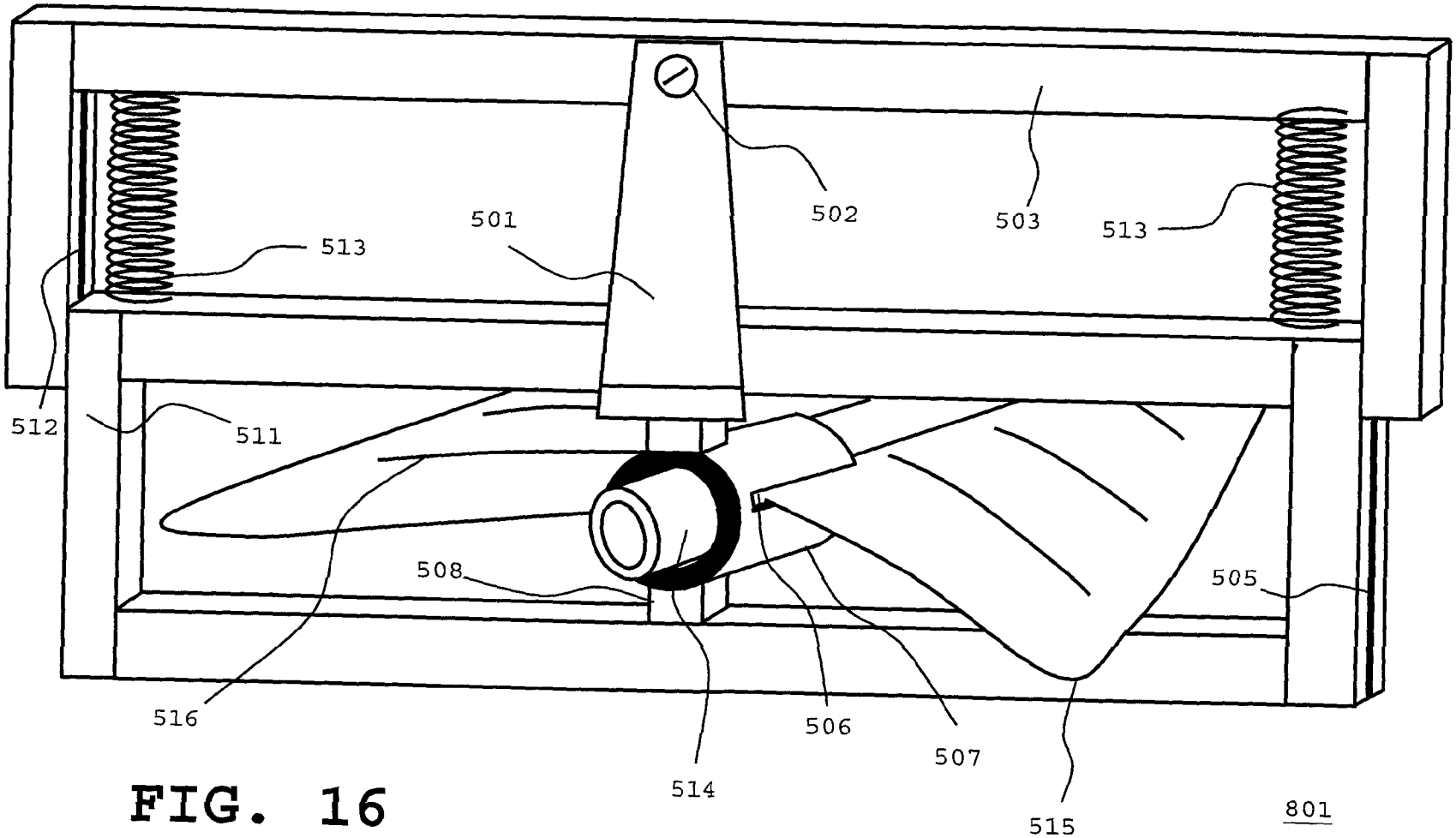
FIG. 16 is a perspective view of an exemplary embodiment of a feather cutter with a first and a second sildable arms having an adjustable blade and a shaft cylinder with two slits in a raised position such that a feather is placed in the shaft cylinder.

FIG. 16 illustrates a perspective view of an exemplary embodiment of the feather cutter 801 with the first and the second sildable arms 503 and 511 having the adjustable blade 501 and the shaft cylinder 507 with two slits 506 in the raised position such that a feather 515 is placed in the shaft cylinder 507. As illustrated in FIG. 16, a feather shaft 514 of the feather 515 may be inserted to the shaft cylinder 507 of the feather cutter 801. A plurality of feather barbs 516 that are connected to the feather shaft 514 are inserted into the two slits 506 of the shaft cylinder 507 to prevent damage to the feather barbs 516. A portion of the feather shaft 514 may remain outside of the opening of the shaft cylinder 507. The portion may be adjusted based on a predefined cutting point. For example, the portion of the feather shaft 514 that remains outside of the opening of the shaft cylinder 507 may be 1, 2, 5, or 10 mm, and preferably, in the range from 0.5 mm to 20 mm. The portion of the feather shaft 514 that remains outside of the opening of the shaft cylinder 507 is the portion that is cut and separated from the feather shaft 514.

The feather 515 is placed in the feather cutter 801 when the feather cutter 801 is in the raised position. To cut the feather shaft 514, the first sildable arm 503 of the feather cutter 801 is moved to the lower position by providing forced to the first and second sildable arms 503 and 511 so that the adjustable blade 501 can cut the portion of the feather shaft 514 that remains outside of the opening of the shaft cylinder 507. Since the adjustable blade 501 is connected the first sildable arm 503, and the first sildable arm 503 is spring-loaded using the plurality of springs 513, the feather cutter 801 snaps when cutting the feather shaft 514.

Figure 17:
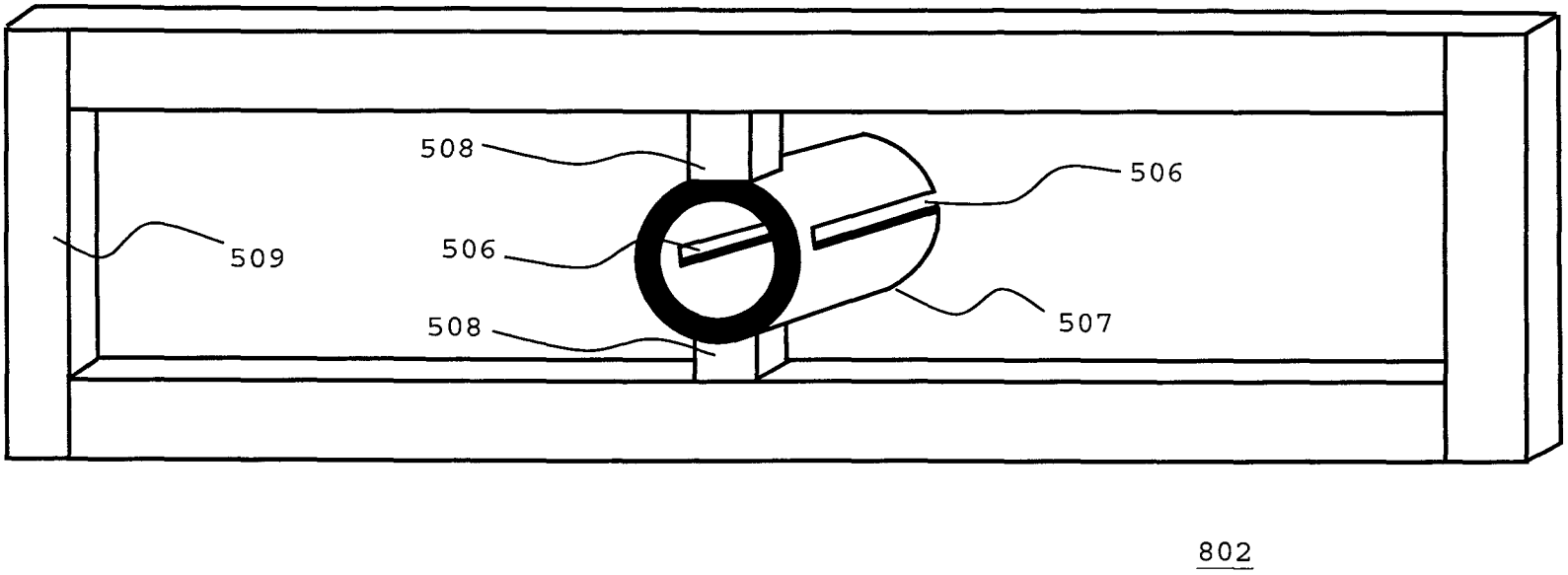
FIG. 17 is a perspective view of an exemplary embodiment of a feather holder for holding feather while a feather being cut that includes a feather holder body that holds a shaft cylinder with two slits such that a feather is placed in the shaft cylinder.

FIG. 17 illustrates a perspective view of an exemplary embodiment of a feather holder 802 for holding a feather while the feather is being cut that includes a feather holder body 509 that holds a shaft cylinder 507 with two slits 506 such that a feather is placed in the shaft cylinder 507. The feather holder 802 may hold a feather with any embodiment of feather cutters as disclosed in the present application. It should be noted that the feather holder 802 is not necessarily required for cutting a feather shaft. However, using the feather holder 802 is preferred to reduce the amount of damage to feather barbs and/or to prevent any damage to the feather barbs. As disclosed in this application, a feather shaft of a feather may be inserted to the shaft cylinder 507 of the feather holder 802. A plurality of feather barbs that are connected to the feather shaft are inserted into the two slits 506 of the shaft cylinder 507 to prevent damage to the feather barbs.

In the following, preferred embodiments of feather cutters are disclosed that can be inserted into a feather shaft of a feather in order to cut the feather shaft. It should be noted that the feather may be hold using the feather holder 802 while the feather is being cut using the disclosed feather cutters. Alternatively, the feather shaft of the feather may be cut without using the feather holder 802.

Figure 18:
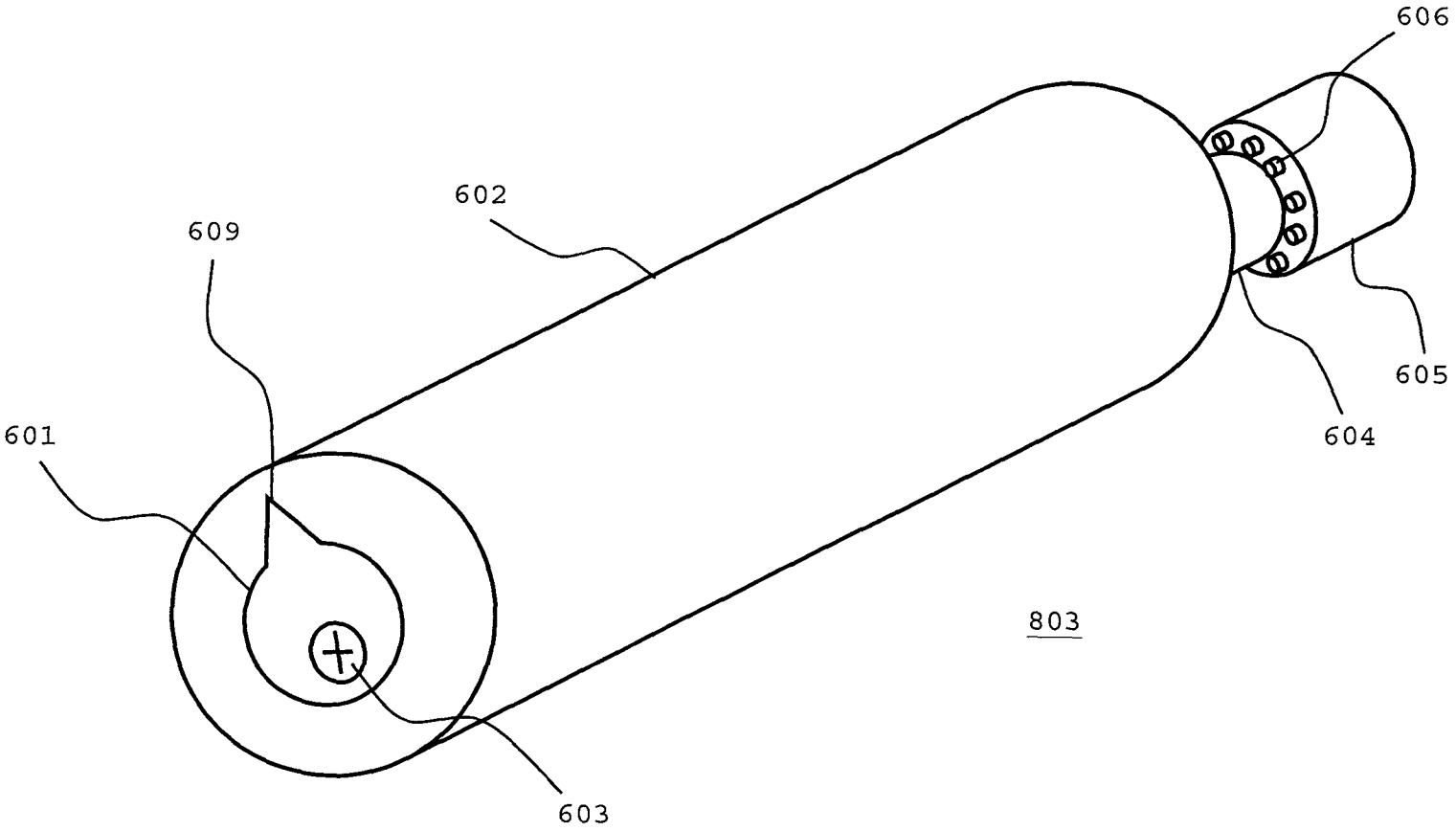
FIG. 18 is a perspective view of an exemplary embodiment of a feather cutter with a blade shaft knob that is connected to a blade via a blade shaft such that the blade is placed in a non-cutting position.

FIG. 18 illustrates a perspective view of an exemplary embodiment of a feather cutter 803 with a blade shaft knob 605 that is connected to a circular blade 601 having a sharp edge 609 via a blade shaft 604 such that the circular blade 601 is placed in a non-cutting position. When the circular blade 601 is placed in the non-cutting position, a cutter shaft 602 of the feather cutter 803 can be inserted within a shaft of a feather. When inserted, the feather cutter 803 can be placed in a cutting position as illustrated in FIG. 19 to cut a feather shaft of a feather by rotating the cutter shaft 602.

Figure 19:
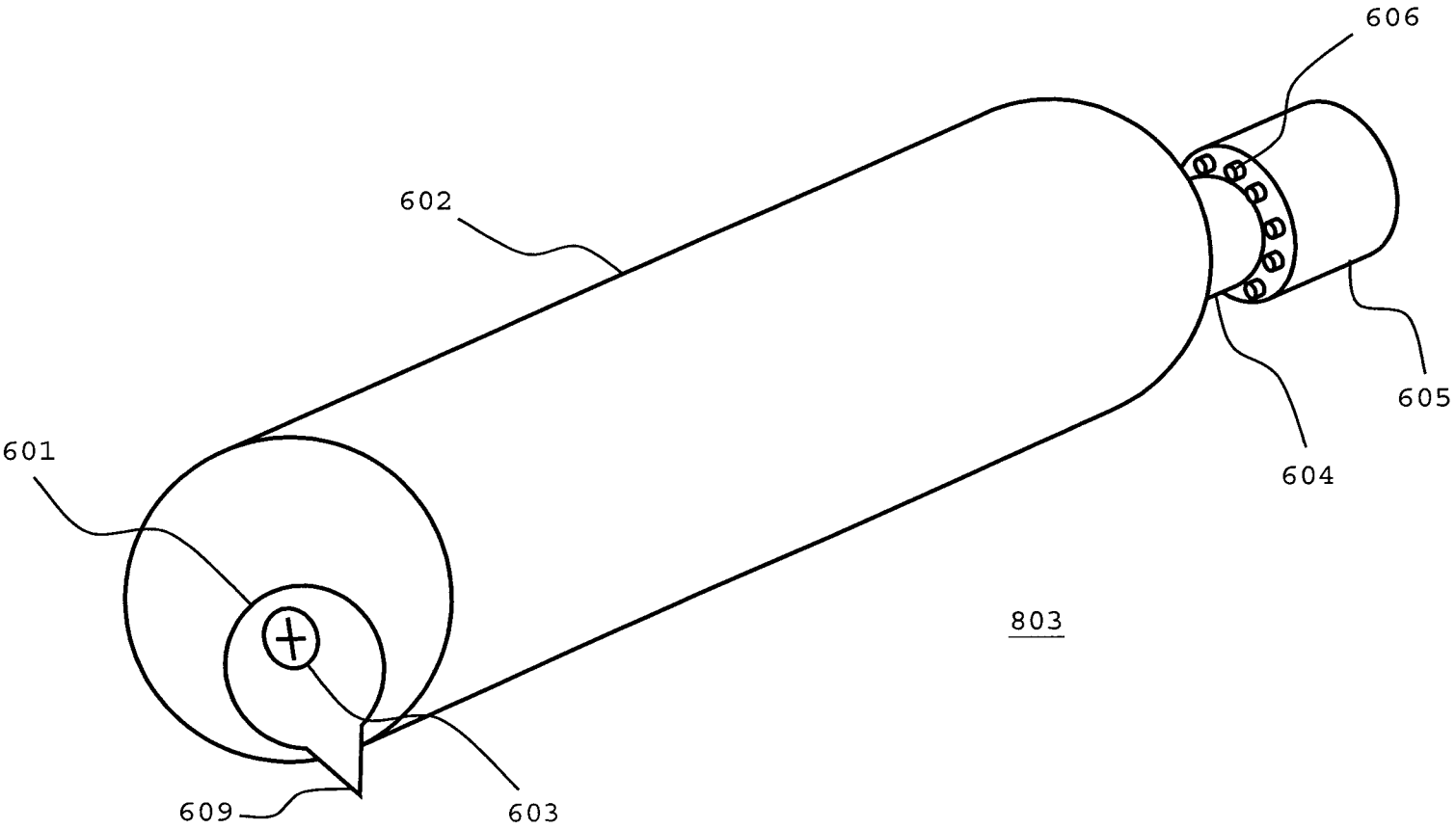
FIG. 19 is a perspective view of an exemplary embodiment of a feather cutter with a blade shaft knob that is connected to a blade via a blade shaft such that the blade is placed in a cutting position.

FIG. 19 illustrates an exemplary embodiment of the feather cutter 803 with the blade shaft knob 605 that is connected to the circular blade 601 having the sharp edge 609 via the blade shaft 604 such that the circular blade 601 is placed in the cutting position. After the feather cutter 803 is inserted within a feather shaft, the blade shaft knob 605 is rotated to place the circular blade 601 the cutting position. When placed in the cutting position, the sharp edge 609 of the circular blade 601 is placed out side of a perimeter of the cutter shaft 602, and the cutter shaft 602 is rotated inside the feather shaft to cut the feather shaft. It should be noted that the circular blade 601 is attached to the blade shaft 604 using a screw 603 and the circular blade 601 can be replaced or adjusted. The cutter shaft 602 may have measurement marks that measure a length of the cutter inserted inside a feather shaft.

Figure 20:
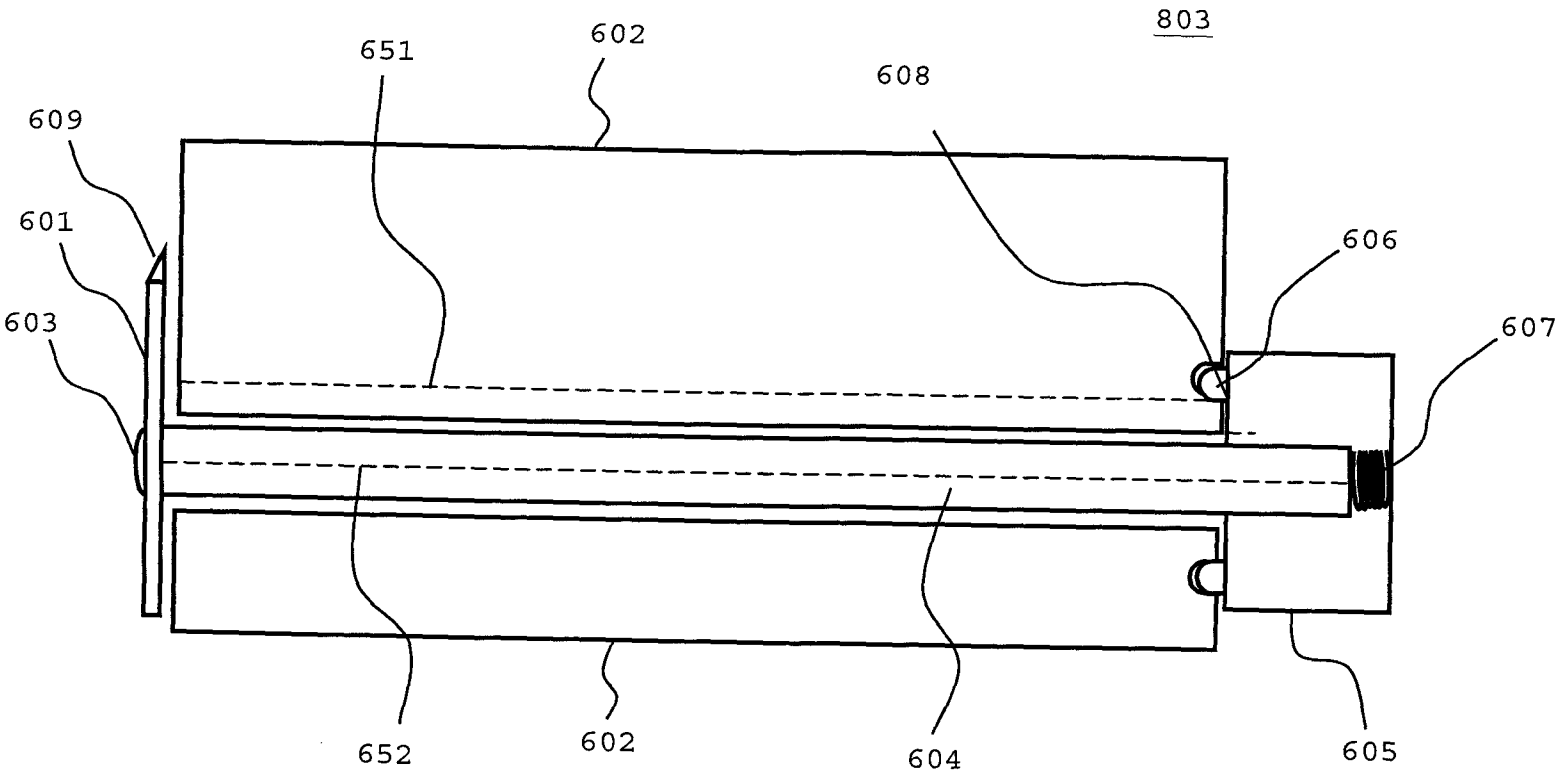
FIG. 20 is a cross-sectional view of an exemplary embodiment of a feather cutter with a blade shaft knob that is connected to a blade via a blade shaft such that the blade is placed in a non-cutting position and the position of the blade is locked via a plurality of cutter pins that are engaged with a plurality of holes.

FIG. 20 illustrates a cross-sectional view of an exemplary embodiment of the feather cutter 803 with the blade shaft knob 605 that is connected to the circular blade 601 via the blade shaft 604 such that the circular blade 601 is placed in the non-cutting position and the position of the circular blade 601 is locked via a plurality of cutter pins 606 that are engaged with a plurality of holes 608. When the circular blade 601 is locked, the plurality of cutter pins 606 are fitted inside the plurality of cutter holes 608 and lock rotation of the circular blade 601 to rotation of the cutter shaft 602. It should be noted that the blade shaft 604 is placed though the cutter shaft 602 off-axis, that is a cutter shaft axis 651 of the cutter shaft 602 is parallel to a blade shaft axis 652 of the blade shaft 604 and a distance between the cutter shaft axis 651 and the blade shaft axis 652 are proportional to the dimensions of the sharp edge 609. For example, the distance between the cutter shaft axis 651 and the blade shaft axis 652 may be in the range from 0.5 to 5 times larger than a height of the sharp edge 609. A diameter/perimeter of the circular blade 603 is smaller than a diameter of the cutter shaft 602. Being off-axis is defined as having parallel axes where the axes are not overlapping.

Figure 21:
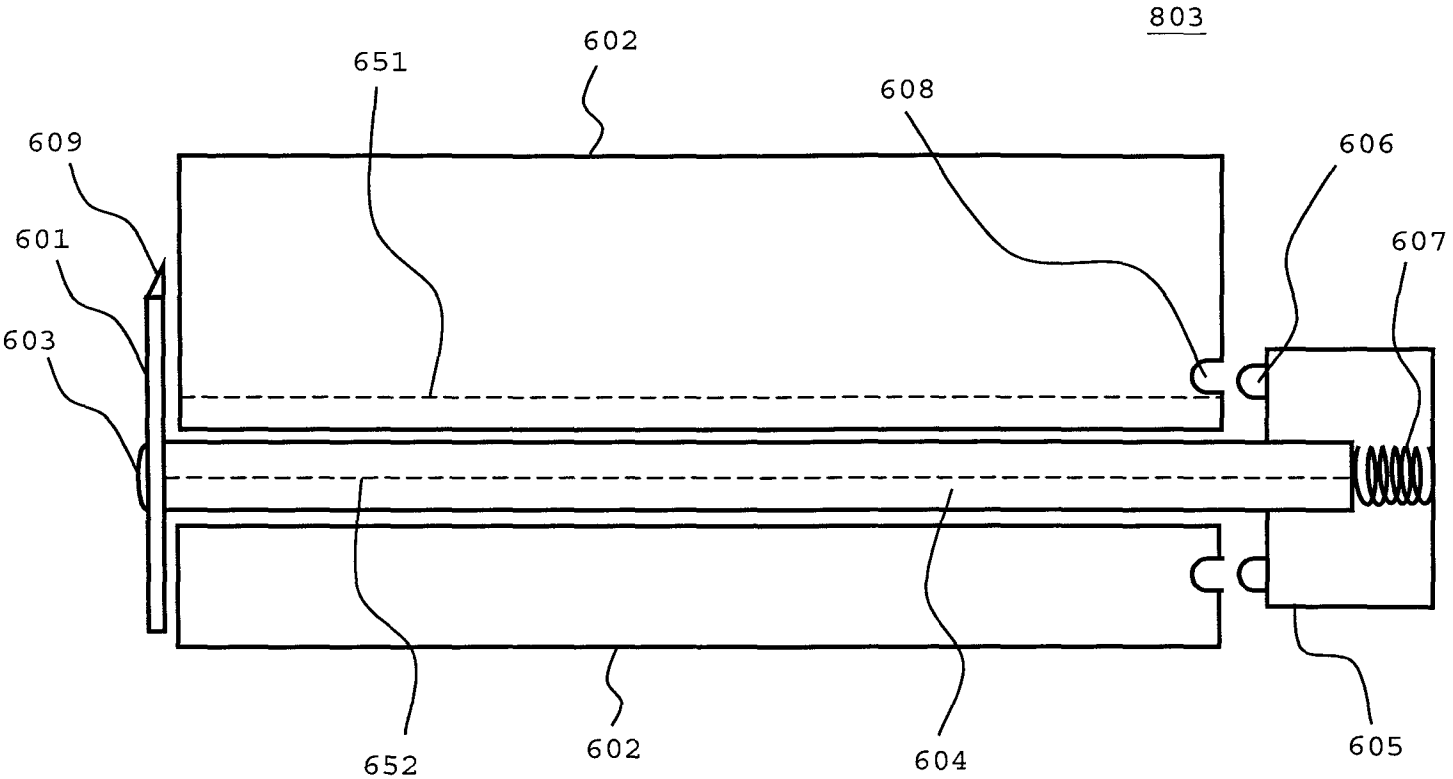
FIG. 21 is a cross-sectional view of an exemplary embodiment of a feather cutter with a blade shaft knob that is connected to a blade via a blade shaft such that the blade is placed in a non-cutting position and the blade can be rotated around the cutter shaft because the cutter blade shaft knob is not locked by a plurality of cutter pins.

FIG. 21 illustrates a cross-sectional view of an exemplary embodiment of the feather cutter 803 with the blade shaft knob 605 that is connected to the circular blade 601 via the blade shaft 604 such that the circular blade 601 is placed in the non-cutting position and the circular blade 601 can be rotated around the cutter shaft 602 because the cutter blade shaft knob 605 is not locked by the plurality of cutter pins 606.

Figure 22:
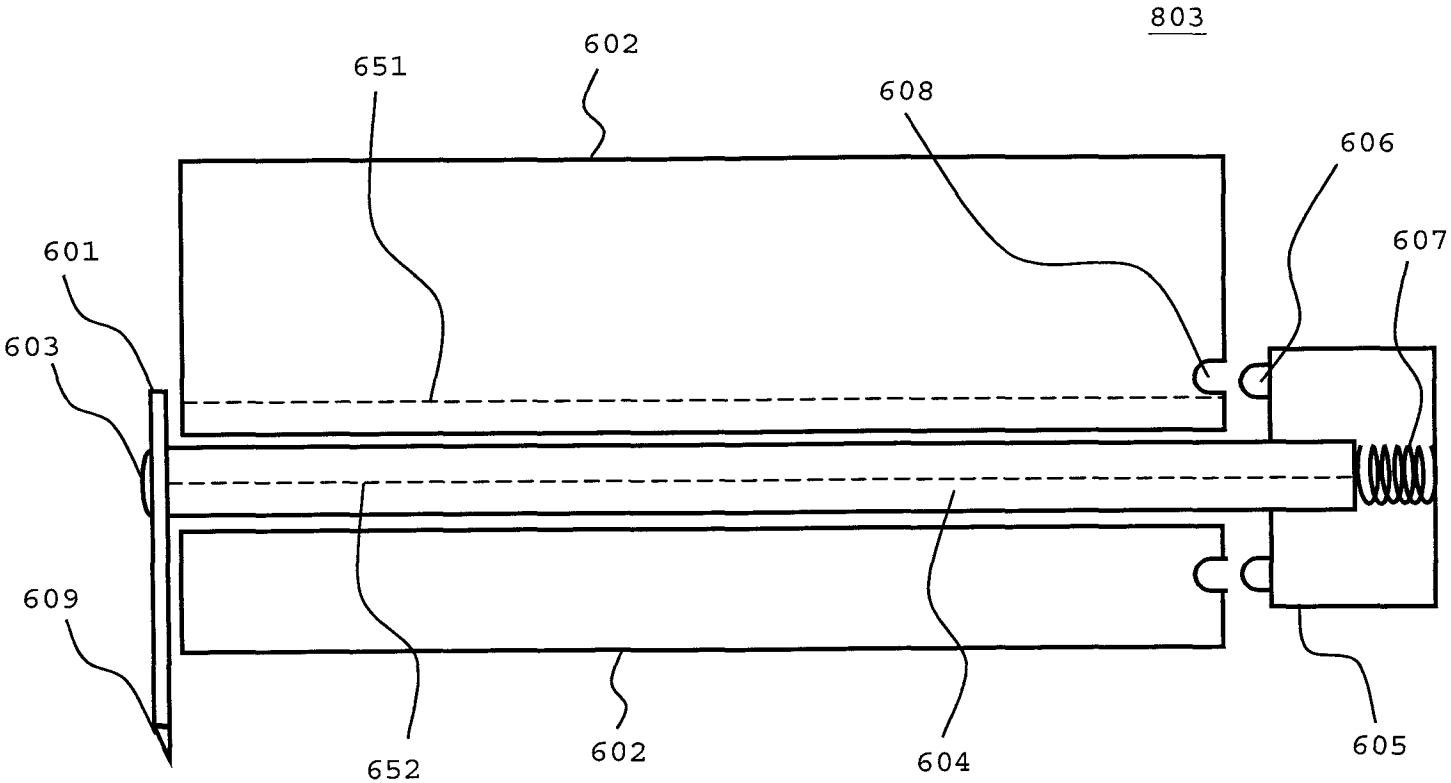
FIG. 22 is a cross-sectional view of an exemplary embodiment of a feather cutter with a blade shaft knob that is connected to a blade via a blade shaft such that the blade is placed in a cutting position and the blade can be rotated around the cutter shaft because the cutter blade shaft knob is not locked by a plurality of cutter pins.

FIG. 22 illustrates a cross-sectional view of an exemplary embodiment of the feather cutter 803 with the blade shaft knob 605 that is connected to the circular blade 601 via the blade shaft 604 such that the circular blade 601 is placed in the cutting position and the circular blade 601 can be rotated around the cutter shaft 602 because the cutter blade shaft knob 605 is not locked by a plurality of cutter pins 606. It should be noted that a spring 607 forces the cutter blade shaft knob 605 in the locked position in which the plurality of the plurality of the pins 606 are engaged with the plurality of holes 608 to lock a rotation of the cutter shaft 602 to a rotation of the circular blade 601. In order to switch between the cutting position and non-cutting position, the cutter blade shaft knob 605 needs to be pushed back, rotated, and released. Upon releasing, the plurality of the plurality of the pins 606 are engaged with the plurality of holes 608.

Figure 23:
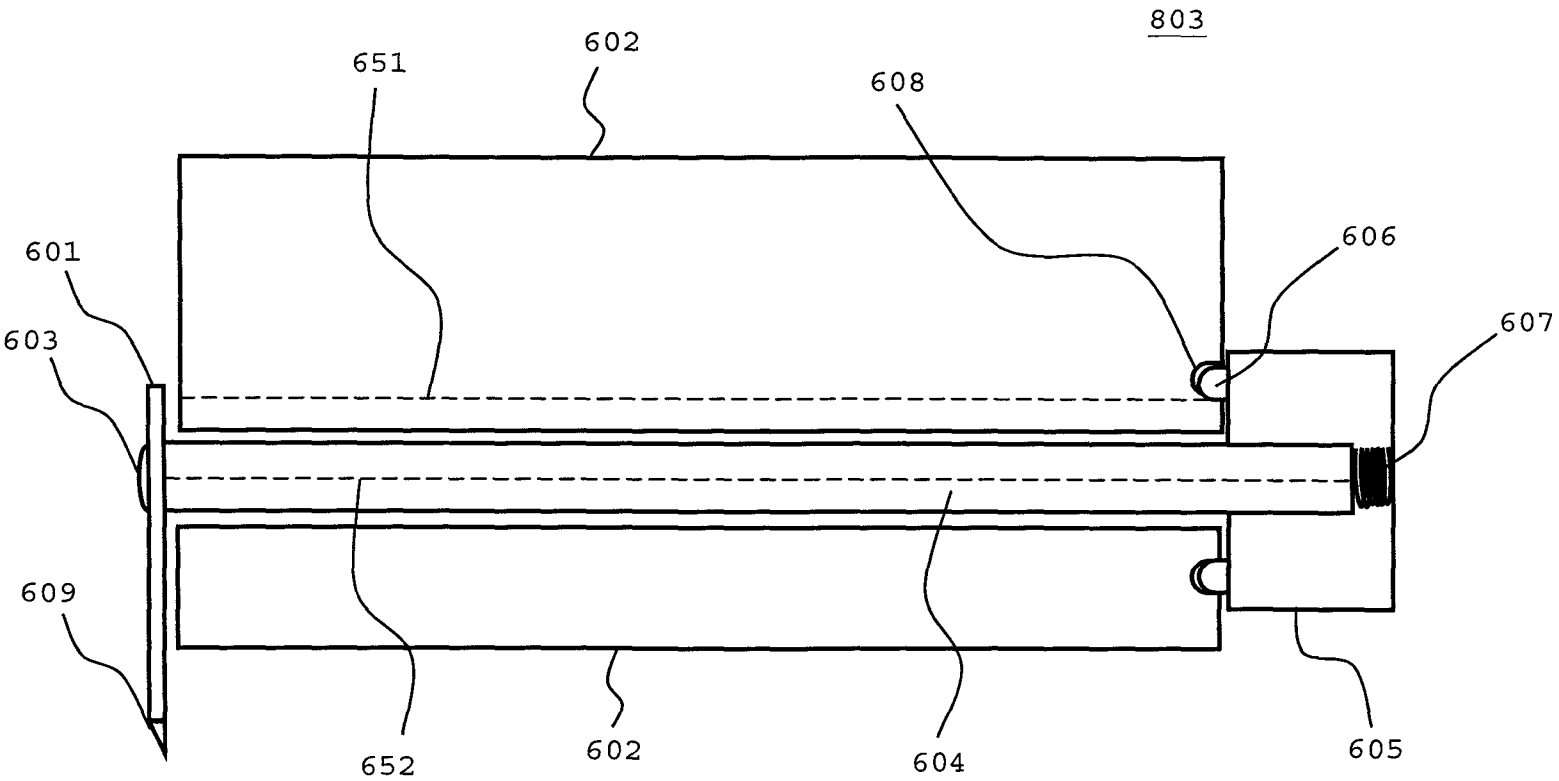
FIG. 23 is a cross-sectional view of an exemplary embodiment of a feather cutter with a blade shaft knob that is connected to a blade via a blade shaft such that the blade is placed in a cutting position and a position of the blade is locked by a plurality of cutter pins that are engaged with a plurality of holes.

FIG. 23 illustrates a cross-sectional view of an exemplary embodiment of the feather cutter 803 with the blade shaft knob 605 that is connected to the circular blade 601 via the blade shaft 604 such that the circular blade 601 is placed in the cutting position and the position of the circular blade 601 is locked by the plurality of cutter pins 606 that are engaged with the plurality of holes 608.

Figure 24:
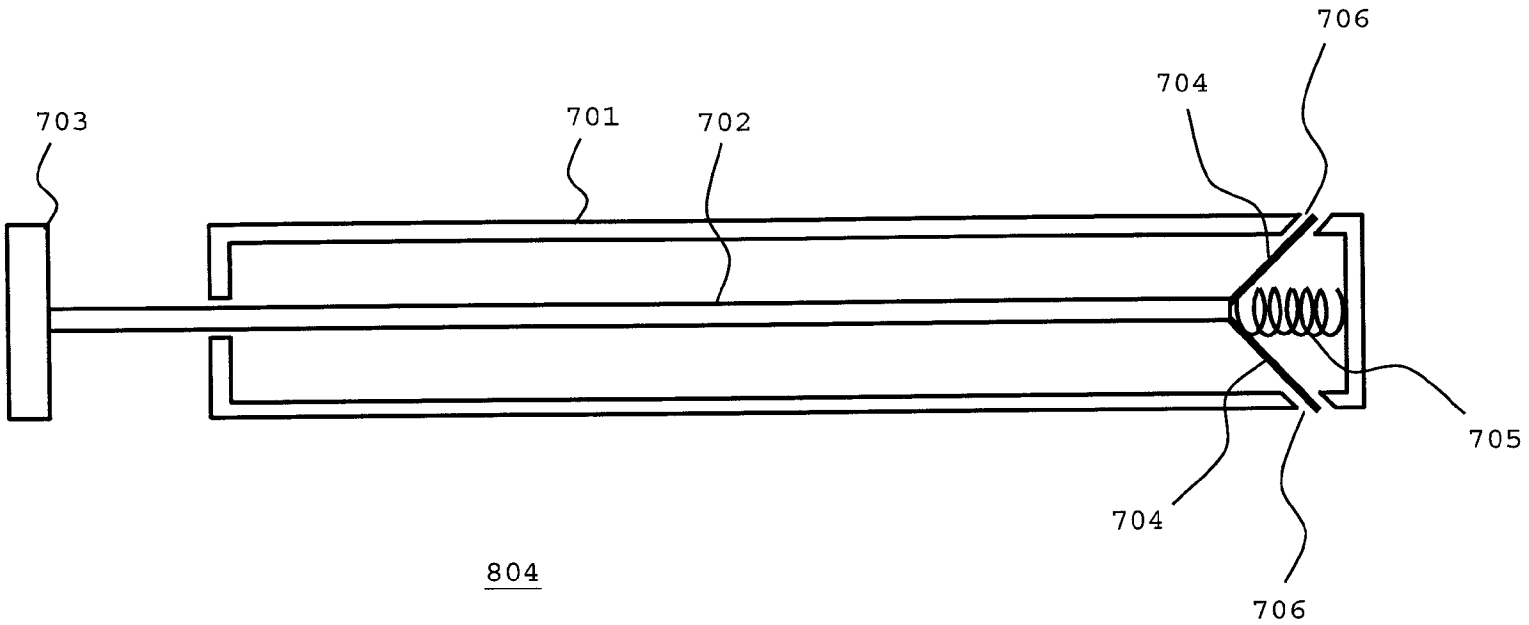
FIG. 24 is a cross-sectional view of an exemplary embodiment of a feather cutter with a cutter knob that is connected to a cone-shape blade via a cutter shaft such that the cone-shape blade is in a non-cutting position.

FIG. 24 illustrates a cross-sectional view of an exemplary embodiment of a feather cutter 804 with a cutter knob 703 that is connected to a cone-shape blade 704 via a cutter shaft 702 such that the cone-shape blade 704 is in a non-cutting position and contained inside a feather cutter body 701.

Figure 25:
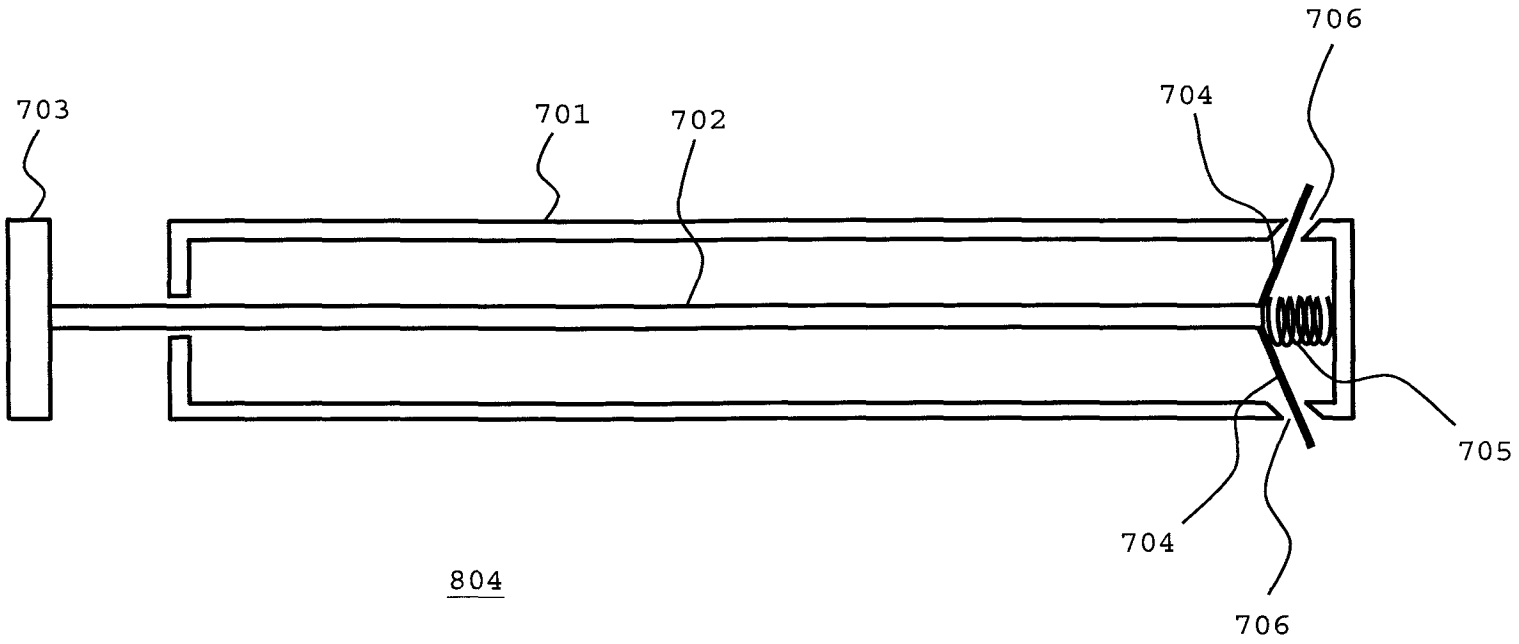
FIG. 25 is a cross-sectional view of an exemplary embodiment of a feather cutter with a cutter knob that is connected to a cone-shape blade via a cutter shaft such that the cone-shape blade is in a cutting position.

FIG. 25 illustrates a cross-sectional view of an exemplary embodiment of the feather cutter 804 with the cutter knob 703 that is connected to the cone-shape blade 704 via the cutter shaft 702 such that the cone-shape blade 704 is in a cutting position and the cone-shape blade 704 is extended outside of the feather cutter body 701 via a plurality of blade holes 706.

In order to cut a feather shaft of a feather, the feather cutter 804 is inserted into the feather shaft in the non-cutting position. After the feather cutter 804 is inserted into the feather shaft, the cutter knob 703 is pushed so that the cone-shape blade 704 is extended to outside of the feather cutter body 701 to cut the feather shaft from an inner surface of the feather shaft. The feather cutter body 701 may have measurement marks that measure a length of the cutter inserted inside a feather shaft. A spring 705 of the feather cutter 804 forces the cone-shape blade 704 to the non-cutting position.

Figure 26:
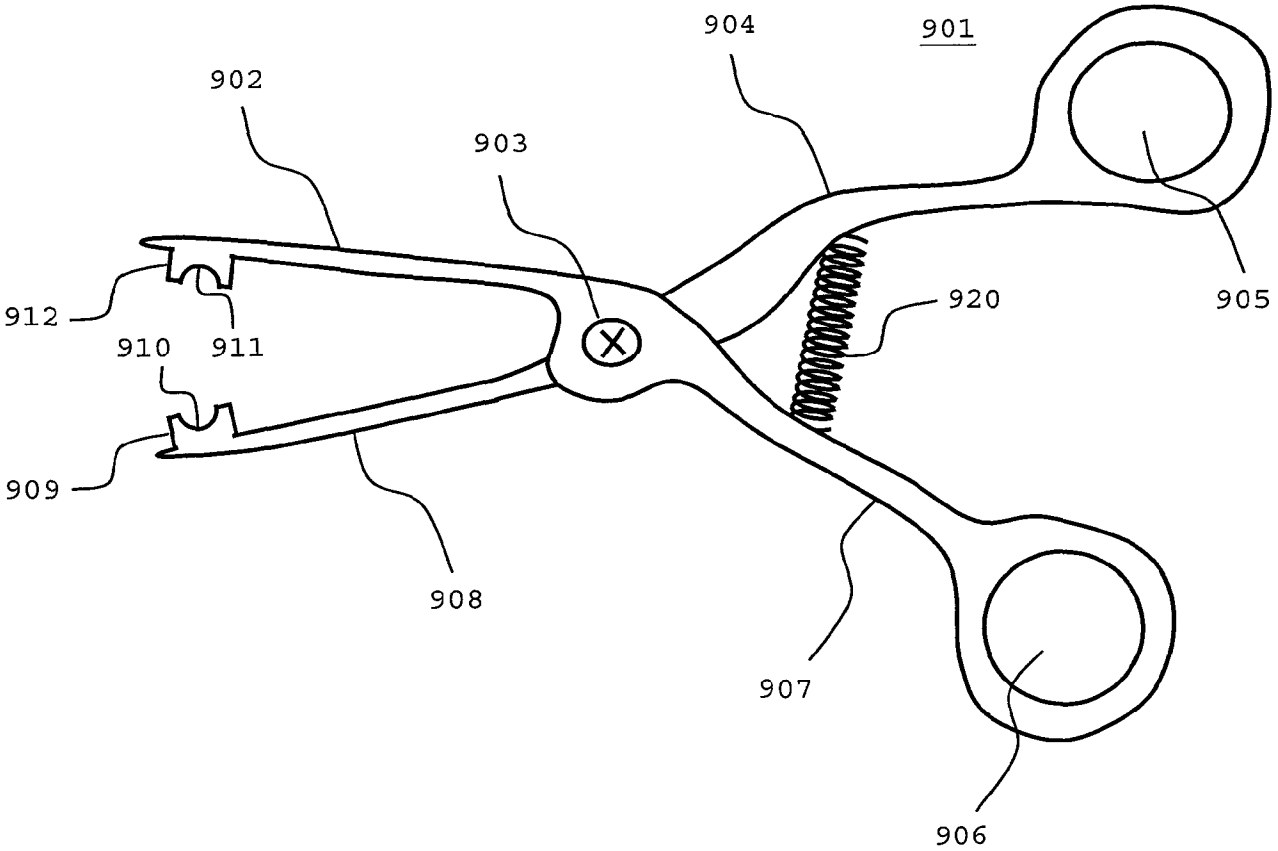
FIG. 26 is an exemplary feather cutting scissor with a first blunt blade having a first blade with a first cutting edge and a second blunt blade having a second blade with a second cutting edge when a first handle connected to the first blunt blade and a second handle connected to the second blunt blade are in an open position.

FIG. 26 illustrates a feather cutting scissor 901 with a first blunt blade 908 having a first blade 909 with a first cutting edge 910 and a second blunt blade 902 having a second blade 912 with a second cutting edge 911 when a first handle 904 connected to the first blunt blade 908 and a second handle 907 connected to the second blunt blade 902 are in an open position.

Figure 27:
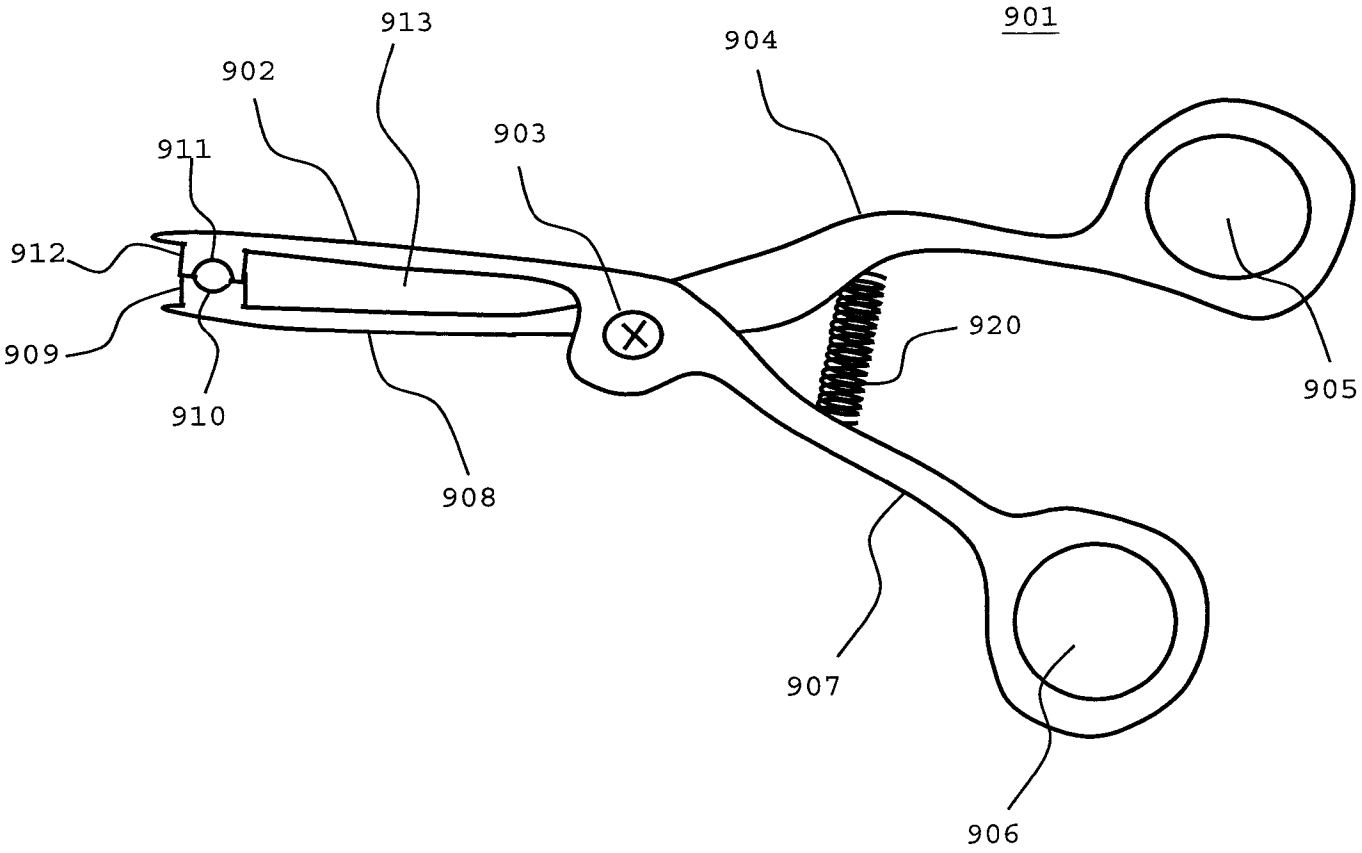
FIG. 27 is an exemplary feather cutting scissor with a first blunt blade having a first blade with a first cutting edge and a second blunt blade having a second blade with a second cutting edge when a first handle connected to the first blunt blade and a second handle connected to the second blunt blade are in a close position.

FIG. 27 is an exemplary feather cutting scissor 901 with a first blunt blade 908 having a first blade 909 with a first cutting edge 910 and a second blunt blade 902 having a second blade 912 with a second cutting edge 911 when a first handle 904 connected to the first blunt blade 908 and a second handle 907 connected to the second blunt blade 902 are in a close position.

The first blunt blade 908 and the second blunt blade 902 are pivoted around a screw 903 so that the first cutting edge 910 of the first blade 909 and the second cutting edge 911 of the second blade 912 slide against each other when the first handle 904 and the second handle 907 opposite to the pivot are closed. A first finger ring 905 and a second finger ring 906 are attached to the first handle 904 and the second handle 907, respectively, that slide the feather cutting scissor 901 open and close.

When closed, an empty space 913 between the first blunt blade 908 and the second blunt blade 902 is formed. When a feather shaft of a feather is being cut, feather barbs remain intact in the empty space 913, which prevent damaging the feather barbs by the first blunt blade 908 and the second blunt blade 902. The first cutting edge 910 and the second cutting edge 911 are half-circular shapes for cutting a feather shaft. A spring 920 is placed between the first handle 904 and the second handle 907 such that the spring forces the feather cutting scissor 901 to the open position.

It should be noted that the exemplary embodiment of the feather cutting scissor 901 is described for application related to cutting a feather shaft. However, the feather cutting scissor 901 can be used in different application when a structure similar to feather shaft is being cut. Examples of similar structures include, but are not limited to, an artery, a vein, and a tendon. The feather cutting scissor can be made of, for example, stainless steel or similar metal alloys.

The first cutting edge 910 and the second cutting edge 911 may have various diameters for use in feathers with different sizes. A range of the diameters may be from 0.1 mm to 10 mm. For example, smaller diameters can be used to cut a feather having a small feather shaft, such as pigeon, and larger diameters can be used to cut a feather having large feather shafts, such as an ostrich or an eagle.

The foregoing discussion discloses and describes merely exemplary embodiments of the present application. As will be understood by those skilled in the art, the present disclosure may be embodied in other specific forms without departing from the spirit or essential characteristics thereof. Accordingly, the disclosure of the present disclosure is intended to be illustrative, but not limiting of the scope of the disclosure, as well as other claims. The disclosure, including any readily discernible variants of the teachings herein, defines, in part, the scope of the foregoing claim terminology such that no inventive subject matter is dedicated to the public.

The invention claimed is:

1. A feather cutter that cuts a feather shaft of a feather, the feather cutter comprising:

a cylindrical cutter shaft having a cylindrical hole parallel to an axis of the cylindrical cutter shaft, cylindrical hole being off-axis;

a cylindrical blade shaft that is placed in the cylindrical hole and is attached to a blade shaft knob via a spring at one end and a circular blade at the other end;

a plurality of pins that are placed on the blade shaft knob; and a plurality of holes that are placed on the cylindrical cutter shaft, wherein the circular blade has a sharp edge that cuts the feather shaft, the blade shaft knob is configured to rotate the circular blade, wherein the sharp edge of the circular blade is fully inside the perimeter of the cylindrical cutter when the feather cutter is in a non-cutting position, the sharp edge of the circular blade is fully or partially outside of the perimeter of the cylindrical cutter when the feather cutter is in a cutting position, the plurality of pins are engaged with the plurality of holes when the feather cutter is locked and the blade shaft knob does not rotate the cylindrical blade shaft, and the plurality of pins are not engaged with the plurality of holes when the feather cutter is un-locked and the blade shaft knob rotates the cylindrical blade shaft.

2. The feather cutter according to claim 1, wherein a rotation of the blade shaft knob causes a corresponding rotation of the circular blade and places the sharp edge of the circular blade inside a perimeter of the cylindrical cutter shaft in a portion of the rotation and places the sharp edge of the circular blade outside of the perimeter of the cylindrical cutter shaft in another portion of the rotation.

3. The feather cutter according to claim 2, wherein the spring is disposed at the end of the cylindrical blade shaft where the blade shaft knife is located.

4. The feather cutter according to claim 2, further comprising:

a feather holder that holds the feather shaft which is being cut, the feather holder including:

an arm that holds a shaft cylinder with two slits that is attached to the arm and the feather shaft of the feather is placed within the shaft cylinder to hold the feather shaft being cut in a fixed position.

5. The feather cutter according to claim 1, wherein the feather cutter is selectively unlockable to switch between the cutting position and the non-cutting position.

6. The feather cutter according to claim 1, wherein the spring urges the cutter shaft knob to the locked position.

* * * * *